US012729046B2

(12) United States Patent
Moreno Brociner et al.

(10) Patent No.: US 12,729,046 B2
(45) Date of Patent: Sep. 8, 2026

(54) SEMIRIGID POUCH FOR FOODSTUFF STORAGE AND DISPENSING

(71) Applicant: Winpak Ltd., Winnipeg (CA)

(72) Inventors: Manuel Jose Moreno Brociner, Winnipeg (CA); Mustafa Bilgen, Fayettville, GA (US); Olivier Yves Muggli, Winnipeg (CA); Ashley Robert Andrews, Kleefeld (CA)

(73) Assignee: Winpak Ltd., Winnipeg (CA)

( * ) Notice: Subject to any disclaimer, the term of this patent is extended or adjusted under 35 U.S.C. 154(b) by 308 days.

(21) Appl. No.: 18/455,513

(22) Filed: Aug. 24, 2023

(65) Prior Publication Data

US 2025/0066091 A1 Feb. 27, 2025

(51) Int. Cl.
*B65D 75/00* (2006.01)
*B65D 41/02* (2006.01)
(Continued)

(52) U.S. Cl.
CPC ..... *B65D 75/008* (2013.01); *B65D 41/02* (2013.01); *B65D 47/14* (2013.01); *B65D 55/16* (2013.01);
(Continued)

(58) Field of Classification Search
CPC ..... B65D 75/008; B65D 41/02; B65D 47/14; B65D 55/16; B65D 75/525;
(Continued)

(56) References Cited

U.S. PATENT DOCUMENTS 3,342,379 A 9/1967 Foley
3,799,914 A * 3/1974 Cushman ..... B65D 75/008 426/115
(Continued)

FOREIGN PATENT DOCUMENTS

CA 2205816 A1 12/1997
CN 202175279 U * 3/2012
(Continued)

OTHER PUBLICATIONS

The International Search Report and the Written Opinion of the International Searching Authority, International Application No. PCT/IB2022/051427, pp. 1-10, dated Jun. 29, 2022.
(Continued)

*Primary Examiner* — Bob Zadeh
(74) *Attorney, Agent, or Firm* — Bond, Schoeneck & King, PLLC

(57) ABSTRACT

The present disclosure provides semirigid pouch designs and methods of manufacturing pouches. Such pouches can be made of plastic or non-plastic materials and may be easily sorted and recycled within existing rigid packaging recycling streams. The pouches are semirigid, while flexible, and will substantially retain their shape during and following product dispensing. This is accomplished by sealing a lower edge of a wall of semirigid plastic or non-plastic materials to a rigid or semirigid base, enabling the pouch to stand up on the base. Portions of an upper edge of the wall are affixed together to form a space to hold the foodstuffs. Further, the present pouch design does not require an additional label to be applied by the manufacturer, as the present design provides a large, uninterrupted, surface area for printing of advertisements and/or labels directly to the outer surface of the pouch.

10 Claims, 17 Drawing Sheets

(51) Int. Cl.

| | |
|---|---|
| ***B65D 47/14*** | (2006.01) |
| ***B65D 55/16*** | (2006.01) |
| ***B65D 75/52*** | (2006.01) |
| ***B65D 75/58*** | (2006.01) |

(52) U.S. Cl.
CPC ..... *B65D 75/525* (2013.01); *B65D 75/5855* (2013.01); *B65D 75/5883* (2013.01); *B65D 2207/00* (2013.01); *B65D 2575/583* (2013.01)

(58) Field of Classification Search
CPC ..... B65D 75/5855; B65D 75/5883; B65D 2207/00; B65D 2575/583; B65D 75/5805
See application file for complete search history.

(56) References Cited

U.S. PATENT DOCUMENTS

| | | | | |
|---|---|---|---|---|
| 4,434,810 | A | 3/1984 | Atkinson | |
| 4,732,299 | A | 3/1988 | Hoyt | |
| 5,307,955 | A | 5/1994 | Viegas | |
| 5,356,039 | A | 10/1994 | Christine et al. | |
| 5,667,107 | A | 9/1997 | Lindsey | |
| 5,950,878 | A | 9/1999 | Wade et al. | |
| 6,079,594 | A | 6/2000 | Brown et al. | |
| 6,622,829 | B2 | 9/2003 | Oliver et al. | |
| 8,596,501 | B2 | 12/2013 | Hans | |
| 8,770,449 | B2 | 7/2014 | Wellman | |
| 8,783,515 | B2 | 7/2014 | Branyon et al. | |
| 8,844,767 | B1 | 9/2014 | Bates et al. | |
| 9,586,740 | B2 | 3/2017 | James et al. | |
| 10,954,039 | B1 | 3/2021 | Iversen et al. | |
| 11,613,417 | B2 | 3/2023 | Moreno Brociner et al. | |
| 2003/0138169 | A1 | 7/2003 | Bell | |
| 2006/0104550 | A1* | 5/2006 | Kuge | B65D 75/008 383/66 |
| 2008/0063320 | A1 | 3/2008 | Michalsky | |
| 2009/0017239 | A1 | 1/2009 | Ursino | |
| 2010/0072224 | A1 | 3/2010 | Ha | |
| 2012/0083398 | A1 | 4/2012 | Berman | |
| 2019/0127136 | A1* | 5/2019 | Bazbaz | B65D 31/02 |
| 2022/0267072 | A1 | 8/2022 | Moreno Brociner et al. | |
| 2022/0297900 | A1 | 9/2022 | Moreno Brociner et al. | |
| 2025/0066091 | A1* | 2/2025 | Moreno Brociner | B65D 55/16 |

FOREIGN PATENT DOCUMENTS

| | | | | | |
|---|---|---|---|---|---|
| CN | 106573714 | A | * | 4/2017 | B65D 75/5816 |
| CN | 104884358 | B | * | 4/2018 | B65D 25/16 |
| DE | 19953549 | A1 | | 5/2001 | |
| EP | 0412390 | A1 | | 2/1991 | |
| EP | 1449787 | A1 | * | 8/2004 | B65D 75/002 |
| EP | 1514805 | A1 | | 3/2005 | |
| JP | 2011006102 | A | * | 1/2011 | |
| KR | 20010079332 | A | | 8/2001 | |
| WO | 2011113539 | A2 | | 9/2011 | |
| WO | 2022175869 | A1 | | 8/2022 | |
| WO | 2013037586 | A1 | | 3/2023 | |

OTHER PUBLICATIONS

Patent Examination Report, NZ Patent Application No. 804018. dated Mar. 28, 2025, pp. 1-6.
Extended European Search Report, EP Patent Application No. 23198875.9, dated Feb. 28, 2024, pp. 1-12.
Patent Examination Report 2, NZ Patent Application No. 804018, dated Oct. 6, 2025, pp. 1-5.
Patent Examination Report 3, NZ Patent Application No. 804018, dated Jan. 15, 2026, pp. 1-4.
Patent Examination Report 4, NZ Patent Application No. 804018, dated Mar. 20, 2026, pp. 1-2.
Notice of Acceptance, NZ Patent Application No. 804018, dated Mar. 30, 2026, pp. 1-2.

* cited by examiner

SEMIRIGID POUCH FOR FOODSTUFF STORAGE AND DISPENSING

FIELD OF THE DISCLOSURE

The present disclosure is directed generally to semirigid pouches that are easy to sort and recycle. Such pouches are used primarily for storing and dispensing solid, liquid, or semi-liquid foodstuffs.

BACKGROUND

Foodstuffs are often sold in flexible, squeezable pouches. Conventional flexible pouches are often flimsy and unstable. Thus, when the conventional pouches have dispensed their product, the conventional pouches lose their initial shape and become substantially flat. In addition, many current recycling streams are unable to recycle flexible materials due to a variety of issues regarding sorting and/or processing, such as flexible plastics getting caught in sorting and/or processing machinery.

SUMMARY OF THE DISCLOSURE

The present disclosure provides novel semirigid pouch designs and methods of manufacturing semirigid pouches. The semirigid pouches, while flexible, will substantially retain their three-dimensional shape and volume during and following product dispensing. As opposed to conventional pouches which lose their initial shape and become flat following product dispensing, the semirigid pouches do not rely on their stored contents to form their overall shape. Thus, the novel semirigid pouches are configured to substantially maintain their three-dimensional shape and volume even when empty. Maintaining their three-dimensional shape and volume allows the semirigid pouches to be easily sorted and recycled within existing rigid packaging recycling streams. Further, the semirigid pouches can be made of plastic or non-plastic materials. This semirigid pouch design is accomplished by sealing a lower edge of a wall of semirigid plastic or non-plastic materials to a rigid or semirigid base, enabling the pouch to stand up on the base. Portions of an upper edge of the wall are affixed together to form a space to hold the foodstuffs. Further, the present pouch design does not require an additional label to be applied by the manufacturer, as the present design provides a large, uninterrupted, surface area for printing of advertisements and/or labels directly to the outer surface of the pouch.

In some examples, the pouch includes a closure assembly to dispense the foodstuffs stored in the pouch. The closure assembly includes a spout affixed to portions of the upper edge or corner of the wall and a cap configured to engage with the spout. Notably, the semirigid wall is stiff enough such that the pouch may stand upright despite the additional weight of the spout and cap. Further, the cap may be tethered to the spout to conform with upcoming recycling regulations.

In some examples, the portions of the upper edge affixed together may form an upper seal, such as a tear open seal or a peelable seal. Breaking the tear open seal at least partially separates the portions of the upper edge and lower edge, thereby exposing the contents of the pouch. Seal tape may be used to prevent an upper portion to be torn from completely detaching from the semirigid wall, thereby conforming with certain recycling rules ensuring all parts of the pouch are recycled together. The peelable seal may be opened by peeling apart the affixed portions of the edge.

In some examples, a vertical seal is formed by affixing two vertical ends of the wall to each other. This vertical seal is preferably formed as a butt joint covered on either (or both) sides by seal tape. The butt joint provides a very smooth and continuous surface for printing or advertisements. Use of seal tape can also protect environmentally sensitive aspects of the wall.

In some examples, the base is semirigid and/or transparent rather than a conventional molded plastic base. In these examples, the base is significantly lighter (and therefore less expensive) than the conventional base while still providing needed stiffness to the pouch. Further, using a transparent base allows for the contents of the pouch to be visible to consumers who may wish to see the product prior to buying or dispensing.

Generally, in one aspect, a semirigid pouch for storing and dispensing foodstuffs is provided. The semirigid pouch includes a base. The base includes a base perimeter. The base perimeter includes a perimeter surface.

The semirigid pouch further includes a semirigid wall. The semirigid wall includes an upper edge and a lower edge. The upper edge includes a first upper edge seal portion, a second upper edge seal portion, a first upper edge spout portion, and a second upper edge spout portion.

The semirigid pouch further includes a closure system. The closure system includes a cap and a spout. The cap is configured to be removably engaged with the spout. The spout is affixed to the first upper edge spout portion and the second upper edge spout portion. According to an example, the closure system may further include a tether. The tether is configured to mechanically couple the cap to the spout.

The lower edge of the semirigid wall is affixed about the perimeter surface of the base. The first upper edge seal portion is affixed to the second upper edge seal portion, thereby forming a space to hold the foodstuffs.

The semirigid pouch is configured to maintain a substantially consistent three-dimensional shape during and following dispensing of the foodstuffs.

According to an example, the semirigid wall further includes a first vertical end and a second vertical end. The first vertical end is affixed to the second vertical end. Further to this example, affixing the first vertical end to the second vertical end may form a butt joint. Seal tape may be applied over at least a portion of the butt joint formed by the first vertical end and the second vertical end.

According to an example, the upper edge may further include a first chamfer portion and a second chamfer portion. The first upper edge spout portion may be positioned within the first chamfer portion. The second upper edge spout portion may be positioned within the second chamfer portion.

According to an example, the base may be semirigid and/or transparent.

Generally, in another aspect, a method for manufacturing a semirigid pouch for storing and dispensing foodstuffs is provided. The semirigid pouch is configured to maintain a substantially consistent three-dimensional shape during and following dispensing of the foodstuffs. The method includes forming a base, wherein the base comprises a base perimeter, and wherein the base perimeter comprises a perimeter surface. The method further includes forming a semirigid wall, wherein the semirigid wall comprises an upper edge and a lower edge, and wherein the upper edge comprises a first upper edge seal portion, a second upper edge seal portion, a first upper edge spout portion, and a second upper edge spout portion. The method further includes affixing a spout of a closure system to the first upper edge spout portion and the second upper edge spout portion, wherein the closure system further comprises a cap configured to be removably engaged with the spout. The method further includes affixing the lower edge of the semirigid wall about the perimeter surface of the base. The method further includes affixing the first upper edge seal portion to the second upper edge seal portion, thereby forming a space to hold the foodstuffs.

According to an example, the method may further include affixing a first vertical end of the semirigid wall to a second vertical end of the semirigid wall to form a butt joint. The method may further include applying seal tape over at least a portion of the butt joint formed by the first vertical end of the semirigid wall and the second vertical end of the semirigid wall.

Generally, in another example, a semirigid pouch for storing and dispensing foodstuffs is provided. The semirigid pouch includes a base. The base includes a base perimeter. The base perimeter includes a perimeter surface.

The semirigid pouch further includes a semirigid wall. The semirigid wall includes an upper edge and a lower edge. The upper edge includes a first upper edge seal portion and a second upper edge seal portion. The lower edge of the semirigid wall is affixed about the perimeter surface of the base.

The semirigid pouch further includes an upper seal formed by affixing the first upper edge seal portion to the second upper edge seal portion, thereby forming a space to hold the foodstuffs.

The semirigid pouch is configured to maintain a substantially consistent three-dimensional shape during and following dispensing of the foodstuffs.

According to an example, the upper seal may be a tear open seal. In an alternative example, the upper seal may be a peelable seal.

According to an example, upon at least partially breaking the tear open seal, the first upper edge seal portion at least partially separates from the second upper edge seal portion.

According to an example, seal tape is applied to the tear open seal to prevent an upper tear portion of the tear open seal from completely detaching from a lower tear portion of the tear open seal.

According to an example, the semirigid wall further includes a first vertical end and a second vertical end. The first vertical end is affixed to the second vertical end. Further to this example, affixing the first vertical end to the second vertical end forms a butt joint. Seal tape may be applied over at least a portion of the butt joint formed by the first vertical end and the second vertical end.

According to an example, the base may be semirigid and/or transparent.

Generally, in another aspect, a method for manufacturing a semirigid pouch for storing and dispensing foodstuffs is provided. The semirigid pouch is configured to maintain a substantially consistent three-dimensional shape during and following dispensing of the foodstuffs. The method includes forming a base, wherein the base comprises a base perimeter, and wherein the base perimeter comprises a perimeter surface. The method may further include forming a semirigid wall, wherein the semirigid wall comprises an upper edge and a lower edge, and wherein the upper edge comprises a first upper edge seal portion and a second upper edge seal portion. The method may further include affixing the lower edge of the semirigid wall about the perimeter surface of the base. The method may further include forming a tear open seal by affixing the first upper edge seal portion to the second upper edge seal portion, thereby forming a space to hold the foodstuffs.

According to an example, the method may further include affixing a first vertical end of the semirigid wall to a second vertical end of the semirigid wall to form a butt joint. Further to this example, the method may further include applying seal tape over at least a portion of the butt joint formed by the first vertical end of the semirigid wall and the second vertical end of the semirigid wall.

These and other aspects of the various embodiments will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various embodiments.

DETAILED DESCRIPTION OF EMBODIMENTS

The present disclosure provides novel semirigid pouch designs and methods of manufacturing semirigid pouches. The semirigid pouches, while flexible, will substantially retain their three-dimensional shape and volume during and following product dispensing. As opposed to conventional pouches which lose their initial shape and become flat following product dispensing, the semirigid pouches do not rely on their stored contents to form their overall shape. Thus, the novel semirigid pouches are configured to substantially maintain their three-dimensional shape and volume even when empty. Maintaining their three-dimensional shape and volume allows the semirigid pouches to be easily sorted and recycled within existing rigid packaging recycling streams. Further, the semirigid pouches can be made of plastic or non-plastic materials. This semirigid pouch design is accomplished by sealing a lower edge of a wall of semirigid plastic or non-plastic materials to a rigid or semirigid base, enabling the pouch to stand up on the base. Portions of an upper edge of the wall are affixed together to form a space to hold the foodstuffs. Further, the present pouch design does not require an additional label to be applied by the manufacturer, as the present design provides a large, uninterrupted, surface area for printing of advertisements and/or labels directly to the outer surface of the pouch. In some examples, the pouch includes a closure assembly with a cap and a spout to dispense the foodstuffs stored in the pouch. In some examples, the portions of the upper edge affixed together may form an upper seal, such as a tear open seal or a peelable seal. In some examples, a vertical seal is formed by affixing two vertical ends of the wall to each other. In some examples, the base is semirigid and/or transparent rather than a conventional molded plastic base.

Figure 1:
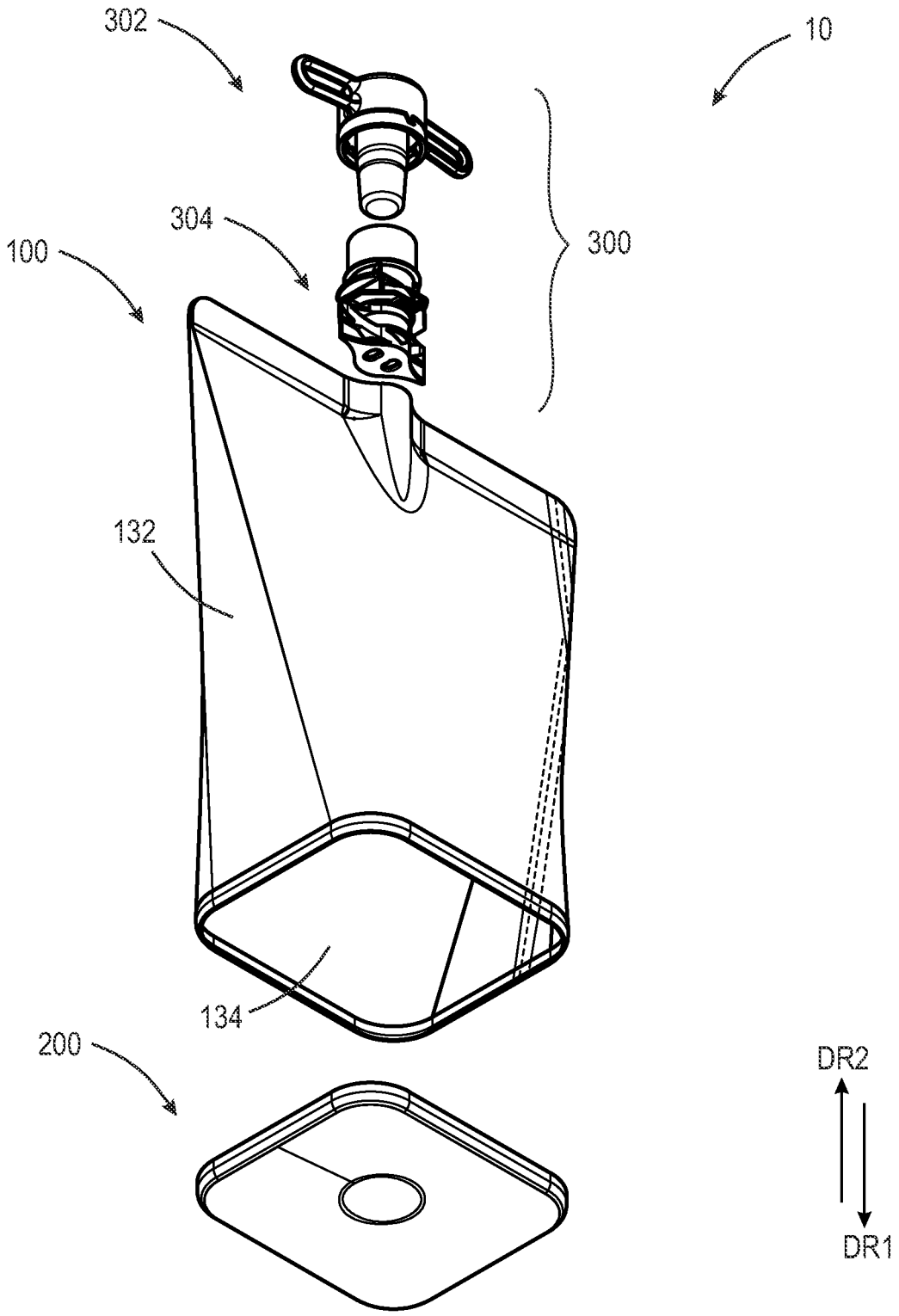
FIG. 1 is a bottom isometric, partially exploded, view of a pouch, according to the present disclosure.

Transitioning now to the figures, FIG. 1 illustrates a partially exploded bottom perspective view of a pouch 10 according to an example the present disclosure. The non-limiting example of the pouch 10 of FIG. 1 is intended to be a receptacle capable of dispensing foodstuffs or other solid, liquid, or semi-liquid materials that are stored in an internal cavity or space S (discussed below) out of a spout 304 of a closure assembly. The components and materials forming the pouch 10 are at least semirigid such that the pouch 10 may stand upright on a base 200 in empty, partially filled, and fully filled scenarios. The flexible nature of the semirigid materials of the pouch 10 allow a user to apply pressure or compressive force to the outside of the pouch 10 to enhance the dispensing of the stored foodstuffs. As discussed below in detail, it should be appreciated that, the sealed structure of the pouch 10 allows for the storage and dispensing of liquids and/or semi-fluid materials, liquids with solid parts or foodstuffs including, but not limited to yogurt, pureed foodstuffs (such as baby food), energy drinks, oils (such as olive oil, vegetable oil, etc.), jams, sauces, or any other liquids and yield stress fluids. Further, the semirigid materials enable the pouch 10 to maintain a consistent, three-dimensional shape during and following product dispensing. In other words, the pouch 10 does not rely on its stored contents (foodstuffs, etc.) to form its overall shape, and an empty pouch 10 will have substantially the same overall three-dimensional shape as a full pouch 10. Maintaining a three-dimensional shape following product dispensing allows the pouch 10 to be easily sorted and recycled within existing rigid packaging recycling streams.

As shown in FIG. 1, the non-limiting example of the pouch 10 includes a wall 100, a base 200, and a closure assembly 300. The wall 100 is defined by an outer surface 132 and an inner surface 134. The closure assembly 300 includes a cap 302 and a spout 304. Broadly, the internal cavity for foodstuff storage is formed by affixing a lower portion of the wall 100 to the base 200. The spout 304 of the closure assembly 300 is affixed to upper portions of the inner surface 134 of the wall 100. The upper portions of the wall 100 are then affixed to each other, sealing off the top of the wall 100 around the spout 304. The cap 302 then engages with the spout 304, thereby fully closing off and sealing the pouch 10.

Figure 2:
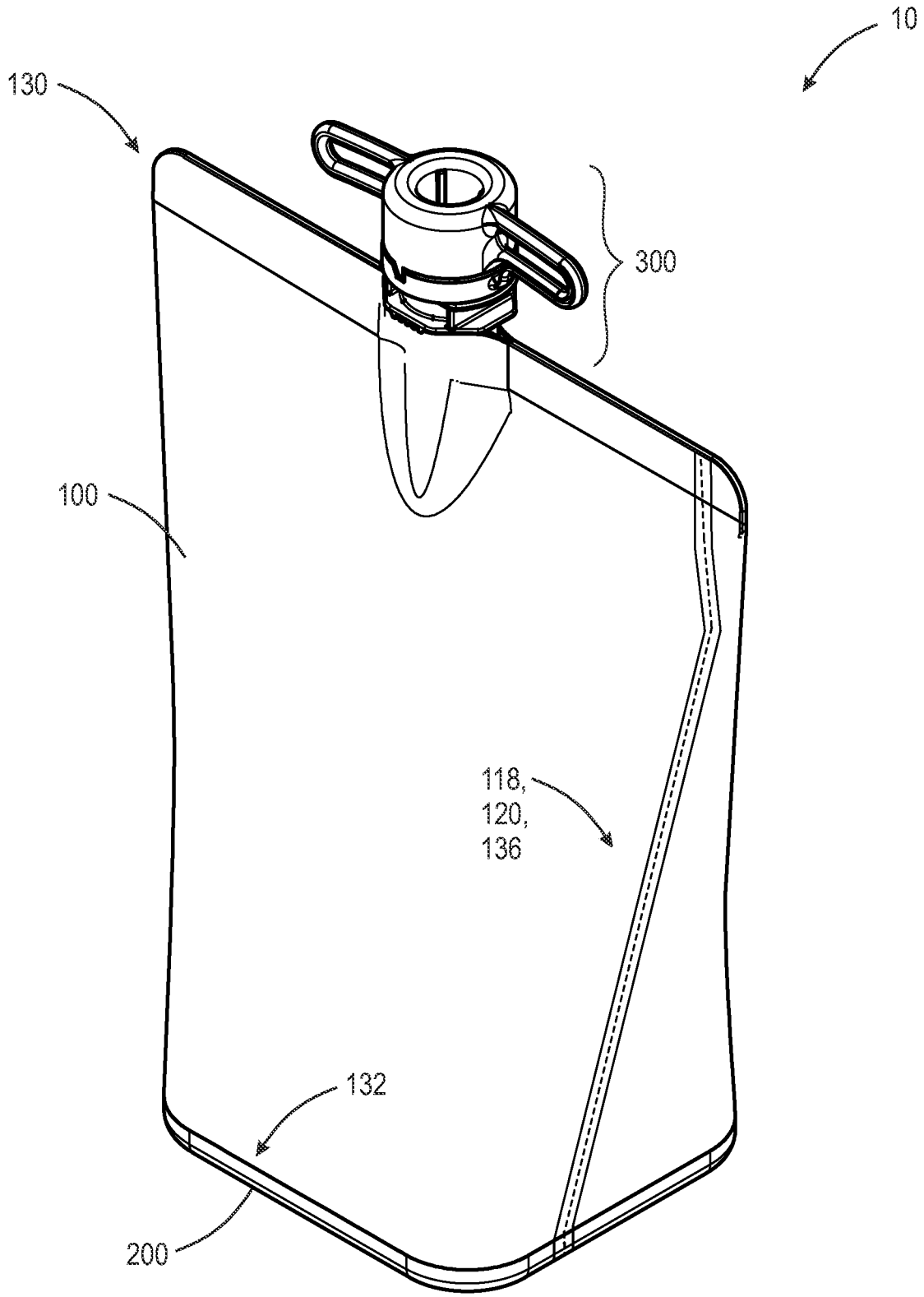
FIG. 2 is a top isometric view of a pouch, according to the present disclosure.

An example assembled pouch 10 is shown in FIG. 2. In the example of FIG. 2, the wall 100 is affixed to the base 200 via a lower seal 132. The upper portion of the wall 100 is affixed to itself via an upper seal 130. The closure assembly 300 is arranged in the middle of the upper seal 130. The upper seal 130 and lower seal 132 may be formed using one or more sealing techniques, such as heat sealing, conduction sealing, induction sealing, adhesive sealing, ultrasonic bonding, welding, laser sealing or any combination thereof. Further, the dimensions of the portions of the wall 100 and the base 200 used to form the upper and lower seals 130, 132 may be adjusted as needed.

The example pouch 10 of FIG. 2 further includes a third seal 136 in the form of a butt joint 118 covered with seal tape 120. The butt joint 118 extends vertically along the wall 100 between the upper seal 130 and the lower seal 132. The butt joint 118 is covered at either or both the inner and outer surface 132, 134 by the seal tape 120 to reinforce the third seal 136. When the butt joint 118 is covered with seal tape 120 only on the inner surface 134 of the wall 100, the outer surface 132 of the wall 100 may appear to be seamless to provide a large, uninterrupted, surface area for printing of advertisements and/or labels. In some alternate examples, the wall 100 is formed in the assembled state of FIG. 2 without a third seal 136. In these examples, the wall 100 may be created using thermoforming or similar manufacturing methods.

Figure 3:
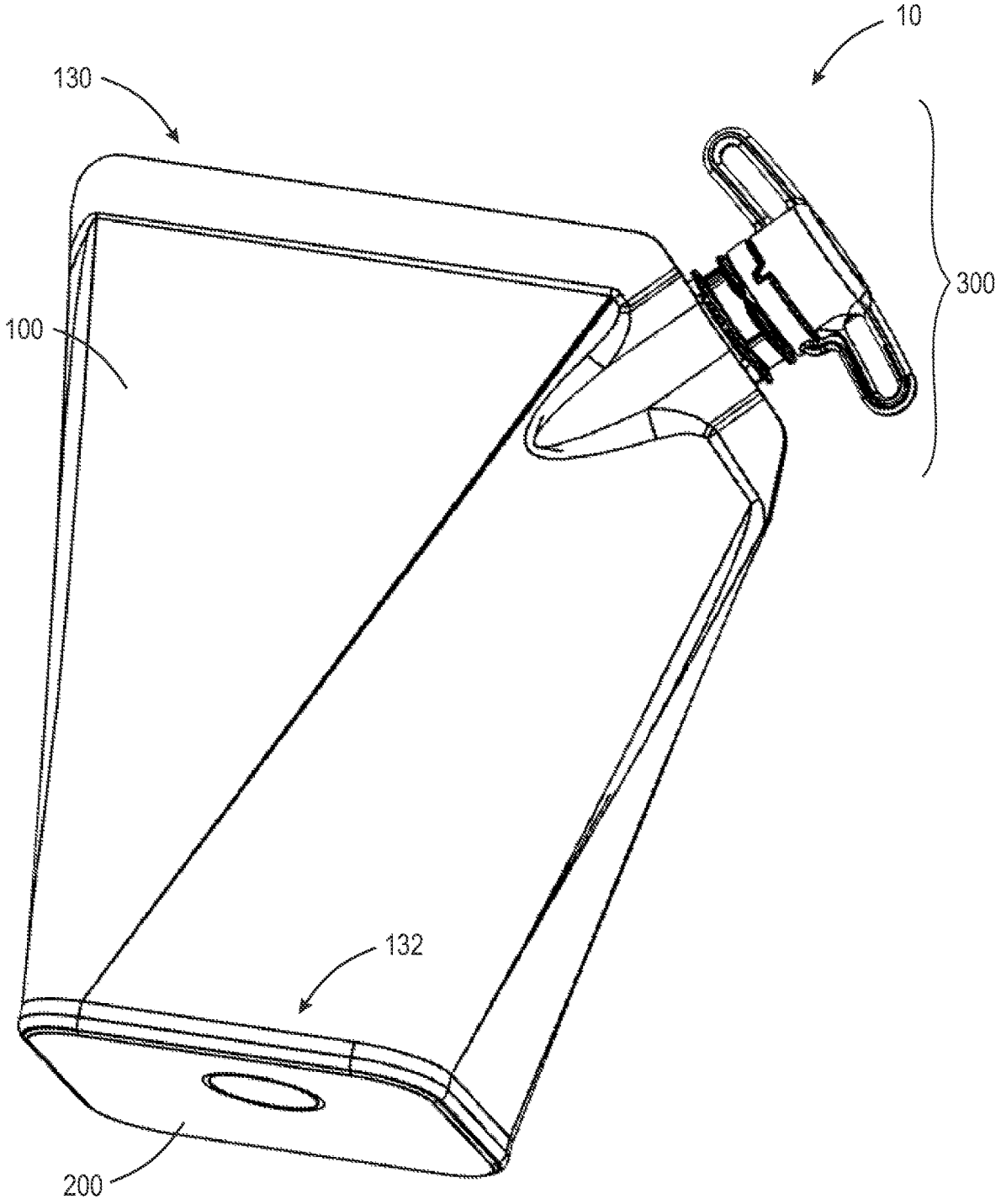
FIG. 3 is a bottom isometric view of a further example of a pouch, according to the present disclosure.

FIG. 3 illustrates a variation of the pouch 10 of FIGS. 1 and 2. In the example of FIG. 3, an upper corner of the wall 100 along the upper seal 130 is chamfered. Further, the closure assembly 300 is arranged within the chamfered corner. Arranging the closure assembly 300 within the chamfered corner may be advantageous for a variety of aesthetic and functional reasons, such as enhanced foodstuff dispensing positioning. The formation of the chamfer is described in greater detail with reference to FIG. 7.

Figure 4:
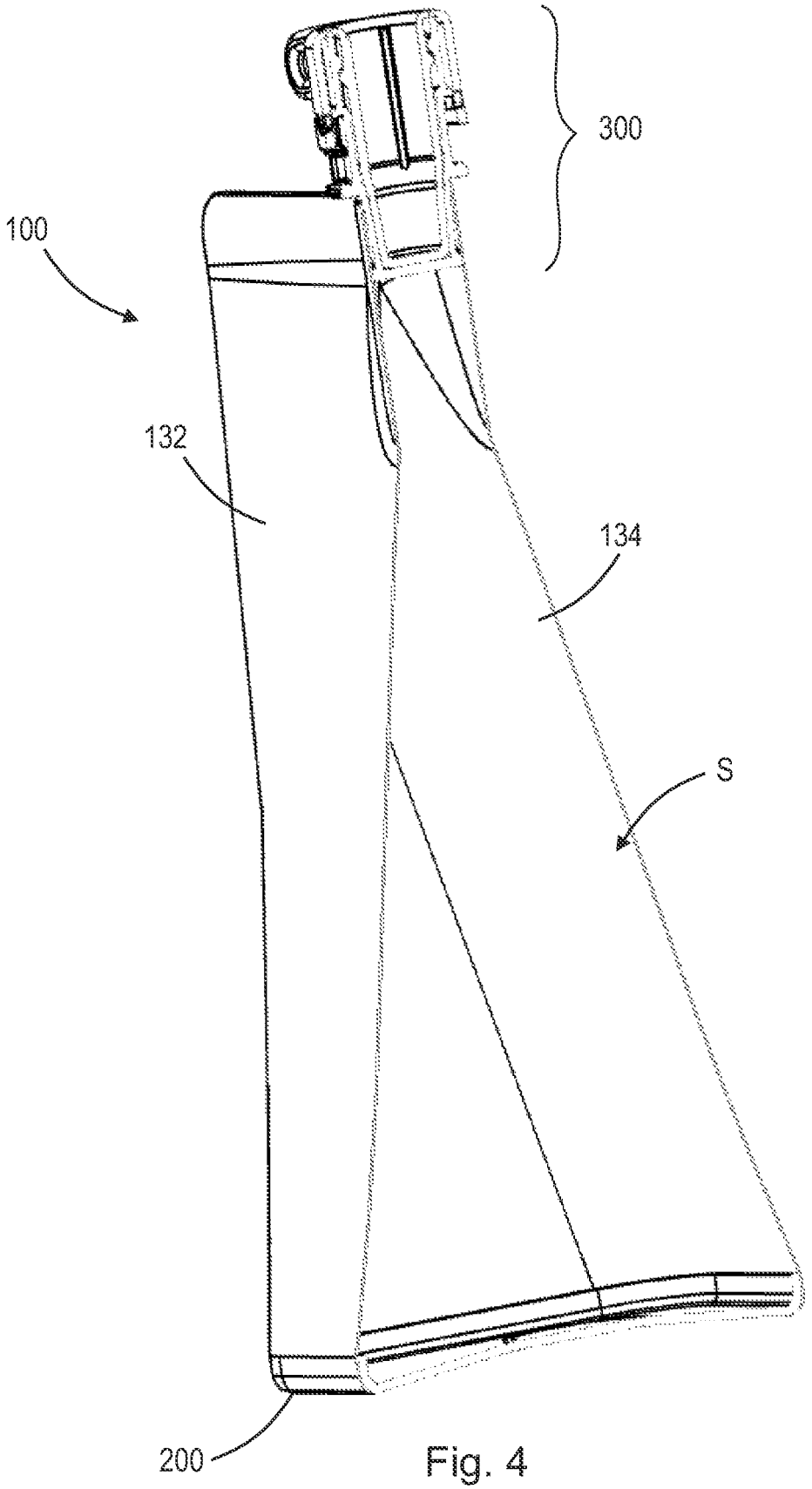
FIG. 4 is a cross-sectional view of the pouch of FIGS. 1 and 2, according to the present disclosure.

FIG. 4 is a cross-sectional view of the assembled pouch 10 of FIG. 2. This cross-sectional view includes cross-sections of the wall 100, the base 200, and the closure 300. The wall 100 is defined by an outer surface 132 and an interior surface 134. Further, the cross-sectional view illustrates the formation of the interior space S formed by sealing the wall 100, the base 200, and the closure 300 together.

As can be observed in the non-limiting example of FIG. 4, the wall 100 is significantly thinner than the base 200. For example, the base 200 may be thermoformed from rigid plastic, while the wall 100 may be a rectangular sheet of plastic or paper. In one example, the wall 100 may have a thickness of 150-250 microns, while the base 200 may have a thickness double or triple the thickness of the wall. By comparison, a conventional, non-rigid squeeze bottle typically has a wall thickness of approximately 100 microns. This rigid base 200 enables the pouch 10 to maintain its overall shape even after the contents of the interior space S have been dispensed and the pouch 10 has been deposited in a recycling receptacle. In further examples, a width of the base 200 is at least two inches, and the length of the base is also at least two inches to conform with recycling stream requirements that a package must have two dimensions greater than or equal to two inches to be processed and recycled.

Figure 5A:
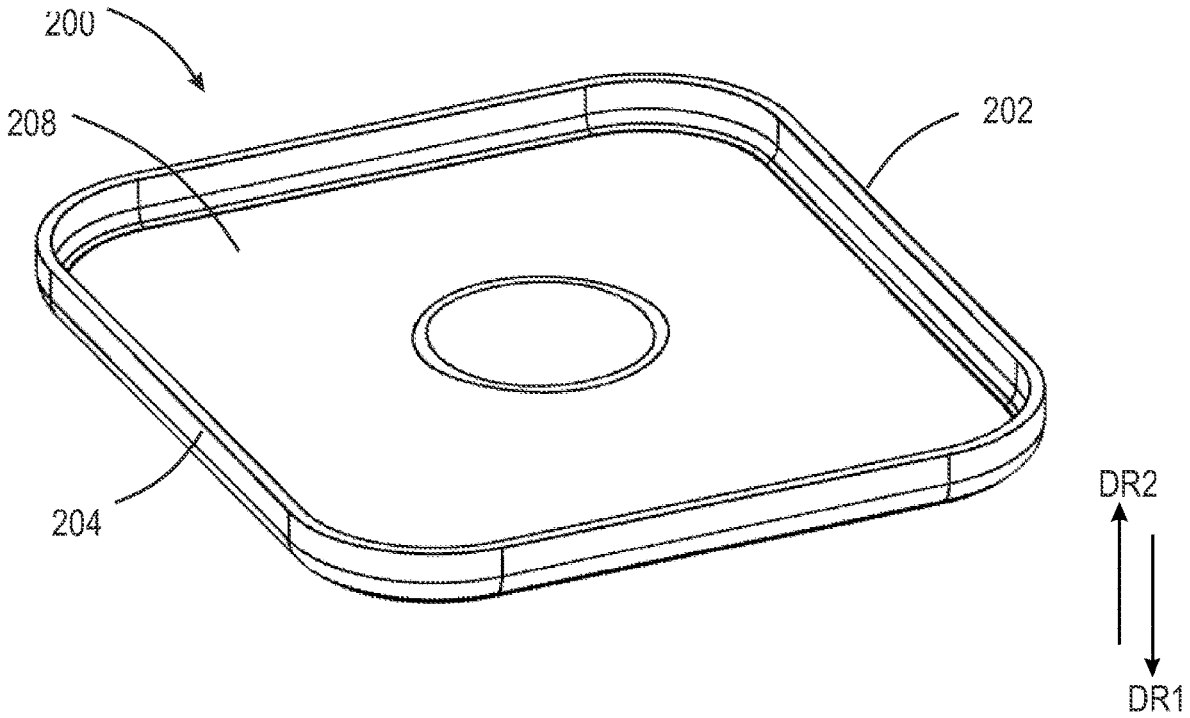
FIG. 5A is a top isometric view of a base, according to the present disclosure.
Figure 5B:
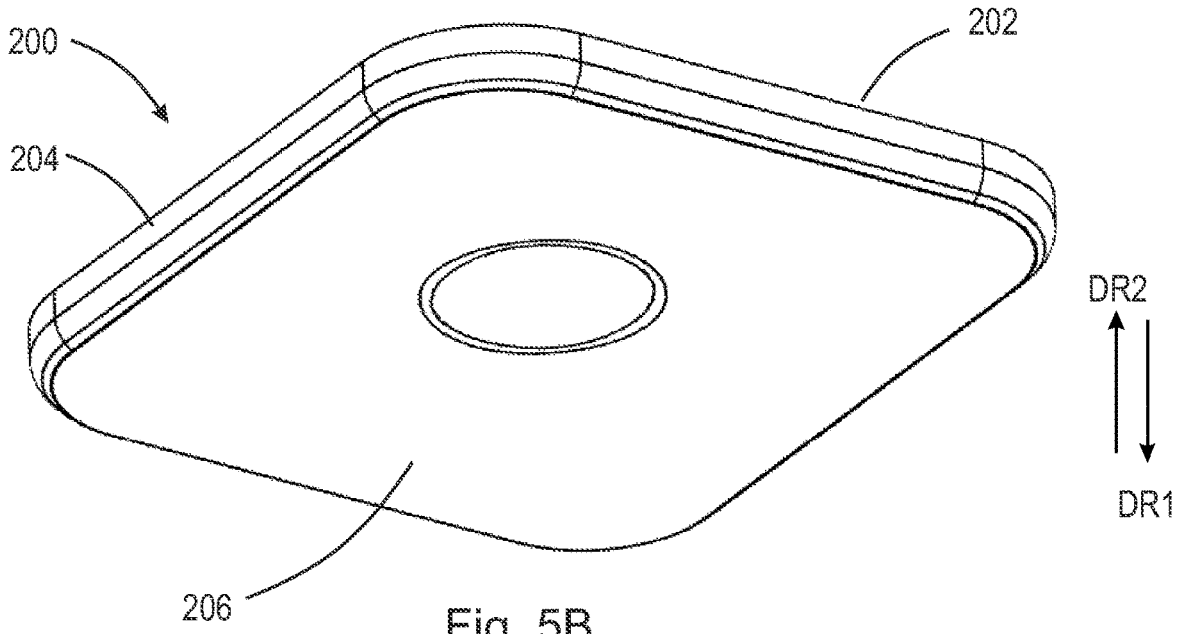
FIG. 5B is a bottom isometric view of a base, according to the present disclosure.
Figure 5C:
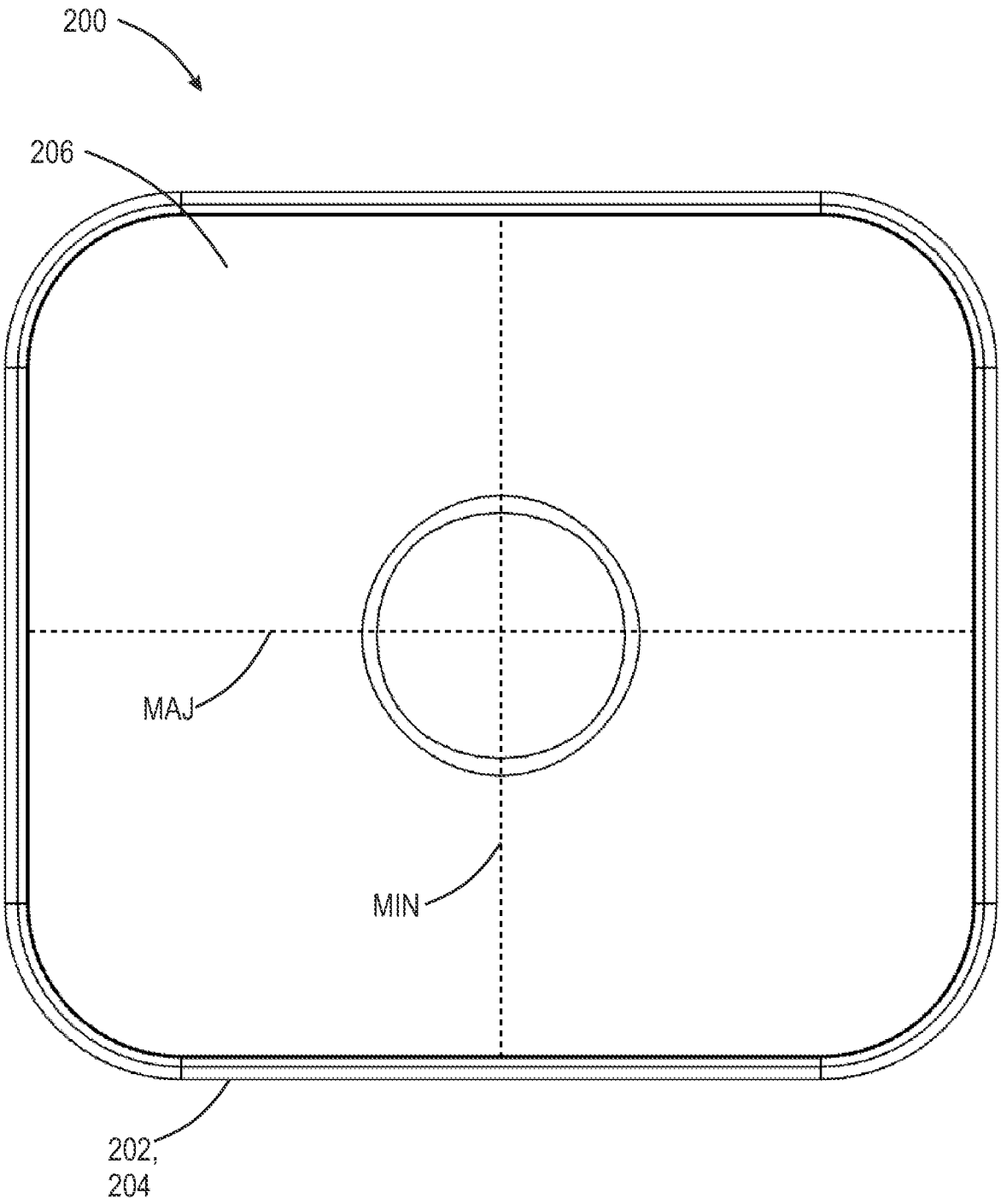
FIG. 5C is a bottom view of a base, according to the present disclosure.

FIGS. 5A-5C, illustrate various views of the base 200 according to the present disclosure. In particular, FIG. 5A illustrates a top isometric view of the base 200, FIG. 5B illustrates a bottom isometric view of the base 200, and FIG. 5C illustrates a bottom view of the base 200. As illustrated in FIGS. 5A and 5B, the base 200 is intended to be a structure or plurality of structures capable of supporting and balancing the pouch 10 when not in use, i.e., when not dispensing foodstuffs or other materials. For example, when not in use, the base 200 is intended to support the weight and contents of the pouch 10 by acting as a standing surface on which the rest of the pouch 10 is supported such that no external support is needed, i.e., the pouch 10 can stand on its own. The base 200 is formed through one or more processes e.g., rotation molding, blow molding, injection molding, compression molding, extrusion molding, coining, cold forming and/or thermoforming. Prior to formation, the base stock material can include a new sheet of stock material or unused portions of previously used stock material. In some examples, the molding processes used utilize one or more heated dies. Additionally, the base 200 is intended to be made primarily of a single type of material, e.g., primarily of polypropylene, polyethylene, polyethylene terephthalate, polyamide, polystyrene, polylactic acid, paper, thermoplastic starch, Polyhydroxyalkanoate, Polyhydroxybutyrate, Polybutylene succinate, or any combination thereof and may contain an oxygen barrier layer where the oxygen barrier layer is made out of, e.g., Ethylene vinyl alcohol. In one example, the base 200 is intended to be formed from a single sheet of stock material, e.g., a single sheet of plastic. In another example, the base 200 is intended to be formed from a single sheet of stock material, e.g., a single sheet of paper. It should be appreciated that in the event the material or foodstuffs stored within the pouch 10 are liquid or semi-liquid, the paper stock material can be lacquered, coated, treated, or sprayed with a hydrophobic coating, e.g., wax or other plastics such as polyolefin dispersions, such that the paper pouch is waterproof. The single sheet is cut to an initial shape and then formed into the defined shapes and structures set forth below. It should be appreciated that the single sheet of stock material is intended to be made primarily of one of the foregoing materials, but can include other trace materials, e.g., additives such as antioxidants, color pigment, slip agents, etc. Furthermore, it should be appreciated that the base 200 can also contain an oxygen barrier layer comprising Ethylene-Vinyl-Alcohol or Polyvinyl-Alcohol or a barrier coating such as metals, metal oxides or polymeric cellulose nano crystals. In some examples, the base 200 is made of renewable resources such as: paper and other cellulose-based materials; Polylactic acid; Polybutylene succinate; Thermoplastic Starch; Polyhydroxalkanoate; Polyhydroxybutyrate; and combinations thereof.

As illustrated, the base 200 includes an outer surface 206 (shown in FIGS. 5B and 5C), an inner surface 208 (shown in FIG. 5A), and a base perimeter 202 (shown in FIGS. 5A-5C). When the pouch 10 is assembled, the pouch 10 is configured to stand upright on the outer surface 206 of the base 200. Further, the inner surface 208 of the base 200 forms, along with the inner surface 134 of the wall 100 and aspects of the closure assembly 300, the inner space S of the pouch 10 configured to store the foodstuffs to be dispensed.

The outer surface 206 and inner surface 208 have an imaginary major axis MAJ and an imaginary minor axis MIN (as shown in FIG. 5C). It should be appreciated that these axes are referred to herein as "major axis MAJ" and "minor axis MIN." In one example, as illustrated in FIG. 5C, example the length of major axis MAJ and the length of minor axis MIN are equal such that the outer surface 206 and the inner surface 208 substantially form a square shape. Although not shown, in another example the length of major axis MAJ is greater or longer than the length of minor axis MIN such that the outer surface 206 and the inner surface 208 substantially form a rectangular shape. Additionally, the outside corners of the outer surface 206 and the inner surface 208 can be filleted or rounded such that the outer surface 206 and the inner surface 208 substantially form a rectellipse (in the case that the major axis MAJ and minor axis MIN are different), or a squircle (in the case that the major axis MAJ and minor axis MIN are equal). Therefore, in some examples, the perimeter of the outer surface 206, for example, can be defined by the quartic curve $x^4/a^4+y^4/b^4=1$, where (x=0, y=0) is the origin between the major axis MAJ and minor axis MIN, and where "a" and "b" are shape parameters and "a" can be in the range of 1.5-30 cm and "b" can be in the range of 1-25 cm. Alternatively, the outer surface 206, for example, can be defined by a different curve having a formula, i.e., $s^2\cdot(x^2/a^2)\cdot(y^2/b^2)-x^2/a^2-y^2/b^2+1=0$, where (x=0, y=0) is the origin between the major axis MAJ and minor axis MIN; "s" is the squareness parameter that varies between 0 and 1; and where "a" and "b" are shape parameters. In one example, "s" is in the range of 0.6-0.9, "a" can be in the range of 2-12 cm and "b" can be in the range of 1.5-10 cm. It should also be appreciated that, although not illustrated, the outer surface 206, for example, can be substantially circular and can have a radius between 2 and 8 cm. In some examples, the diameter of the circular base shape can be selected from between 2 cm to 30 cm. In some examples where the base 200 is shaped as a rectellipse, the length of the base 200 can be selected from between 2 cm and 30 cm.

Extending upward from the outer surface 206, i.e., extending in a second direction DR2, the base 200 includes an integrally formed base perimeter 202. In the examples of FIGS. 5A-5C, the base perimeter 202 is formed as a lip or an extruded wall that extends in second direction DR2 and encompasses or surrounds inner surface 208 of the base 200. The base perimeter 202 includes an outer surface, i.e., a base perimeter surface 204 configured to receive, engage with, and seal to the inner surface 134 of wall 100 to form the upper seal 130.

Figure 5D:
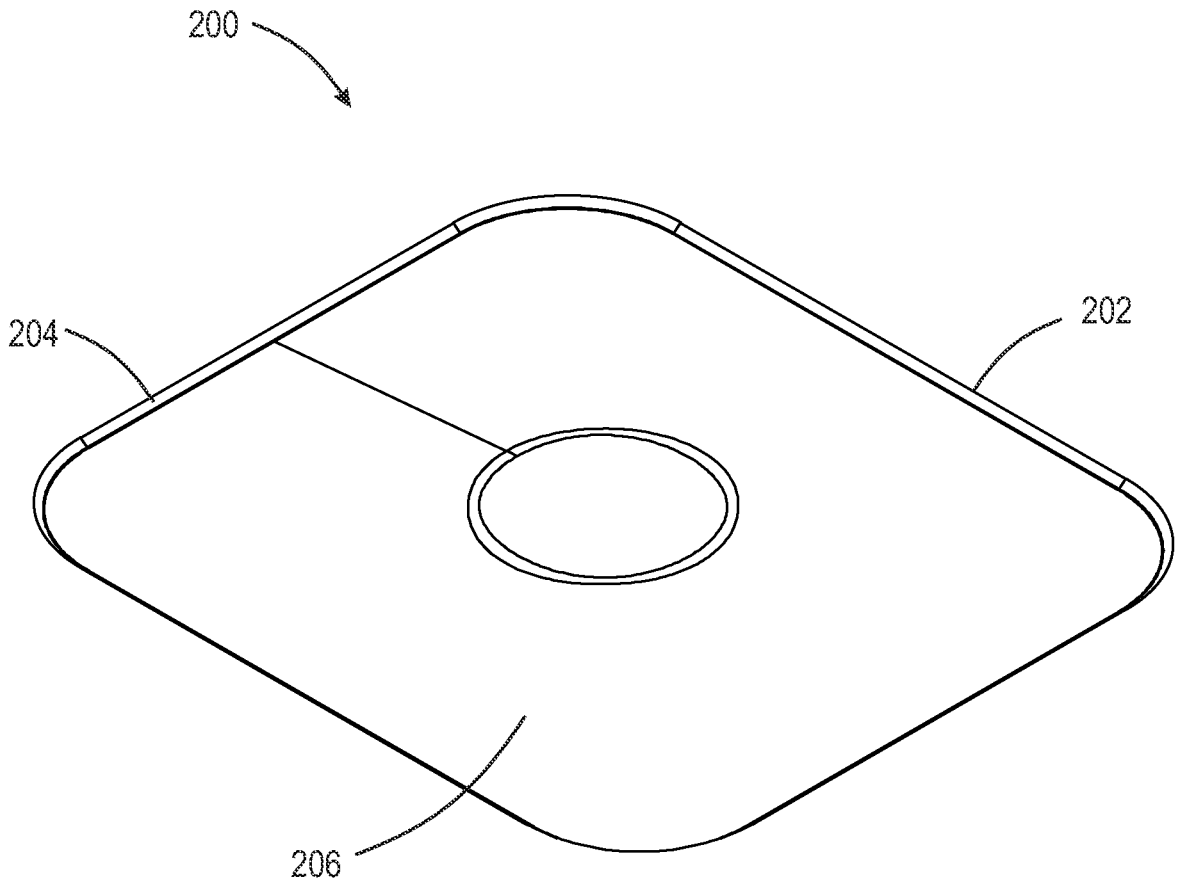
FIG. 5D is a bottom isometric view of a semirigid base, according to the present disclosure.

In some alternative examples to the base of FIGS. 5A-5C, the base 200 may not be a rigid structure, but may instead be formed from a semirigid material. A semirigid base 200 is illustrated in FIG. 5D. In some cases, a semirigid base 200 may be preferred to reduce material costs. However, the semirigid base 200 may also be more prone to lose its shape than the rigid base 200, which may prevent the container 10 as a whole from being recycled. In some examples, the material and/or thickness of the semirigid base 200 may be chosen such that the semirigid base 200 is substantially transparent or translucent. The transparent base 200 may provide additional benefits in terms of allowing a consumer to view the product inside the pouch 10 prior to purchase.

Like the rigid base of FIGS. 5A-5C, the semirigid base 200 of FIG. 5D will have a defined base perimeter 202 and a perimeter surface 204 to form a seal with the wall 100. However, the semirigid base 200 is typically a flat sheet of material rather than a thermoformed plastic body. Thus, the base perimeter 202 will not be formed as a lip or wall as shown in FIGS. 5A and 5B. Instead, as shown in FIG. 5D, the base perimeter 202 may be defined as the perimeter around a flat sheet of material, and the perimeter surface 204 may be defined as the thickness along the outer edge of the base 200. When forming the lower seal 132, this thickness is sealed to the inner surface 134 of the wall 100.

Generally, the thickness of a semirigid base 200 will be significantly less than a rigid base 200. The thickness of the wall 100 may be less than or equal to the thickness of the semirigid base 200. In some examples, the material of the semirigid base 200 may be of the same type as the material of the wall 100, though, in other examples, the wall 100 and the semirigid base 200 may be formed of different materials.

Figure 6:
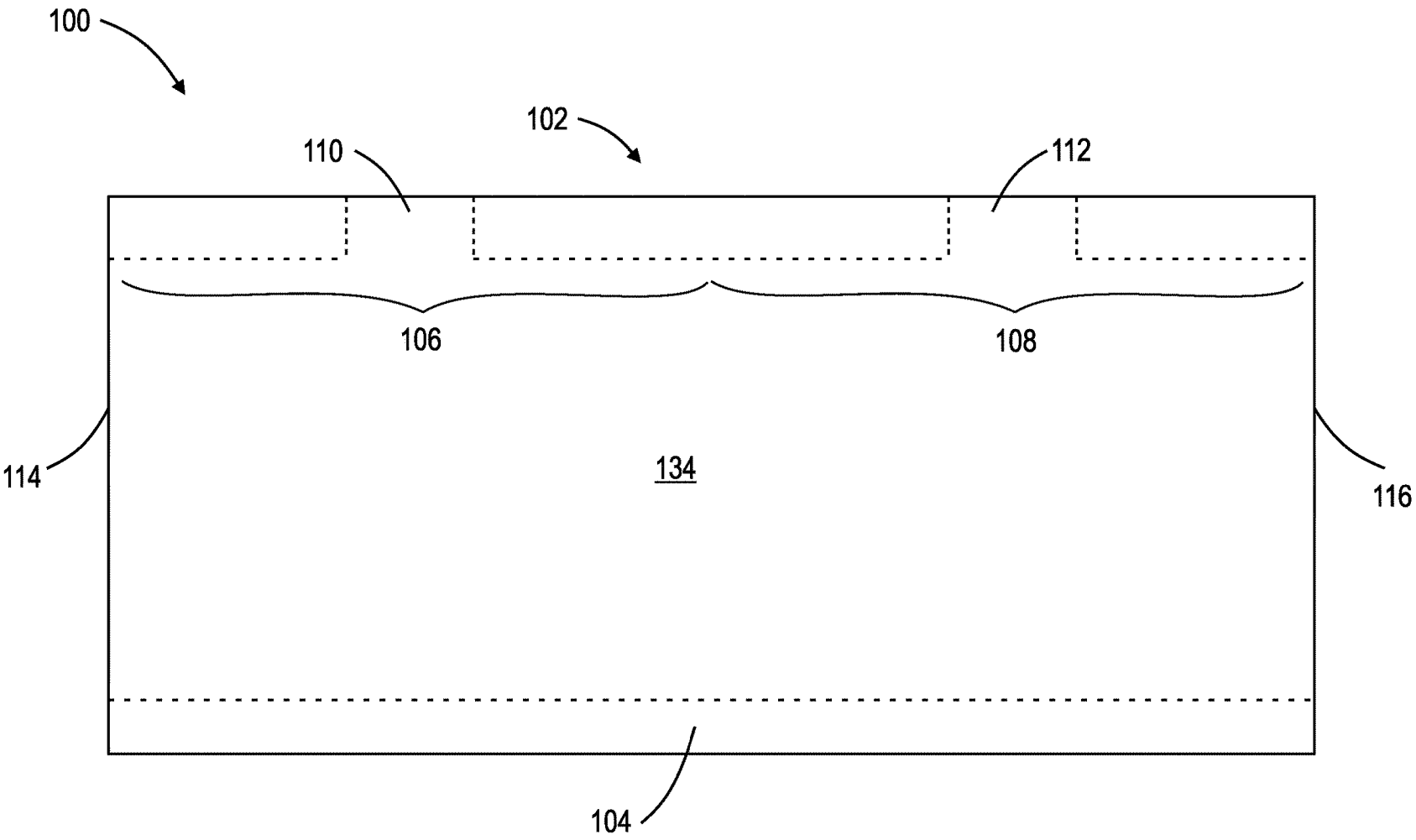
FIG. 6 is a side elevational view of a first example of an unassembled wall, according to the present disclosure.

FIG. 6 is a side elevational view of a first example of an unassembled wall 100. The wall 100 of FIG. 6 (as well as FIGS. 1-4) is a single, unitary, wall 100 configured to seal to itself and wrap around and seal to the perimeter surface 204 of base 200 to form an internal space S to store a product such as foodstuffs. As illustrated, the wall 100 is a single continuous segment of stock material configured to form a substantial portion of the body of pouch 10, e.g., the portion of pouch 10 that is primarily responsible for storing solid, liquid, or semi-liquid foodstuffs. Similarly to the single sheet of stock material used for forming base 200 (discussed above), the single continuous segment of stock material for forming wall 100 can be selected from, e.g., materials made primarily of polypropylene, polyethylene, polyethylene terephthalate, polyamide, polystyrene, polylactic acid, paper thermoplastic starch, Polyhydroxyalkanoate, Polyhydroxybutyrate, Polybutylene succinate, or any combination thereof and may contain an oxygen barrier layer where the oxygen barrier layer is made out of, e.g., Ethylene vinyl alcohol. In one example, the wall 100 is intended to be formed from a single sheet of stock material, e.g., a single sheet of plastic. In another example, the wall 100 is intended to be formed from a single sheet of stock material, e.g., a single sheet of paper. It should be appreciated that in the event the material or foodstuffs stored within the pouch 10 are liquid or semi-liquid, the paper stock material can be treated or sprayed with a hydrophobic coating, e.g., wax or other plastics such as polyolefin dispersions. The single sheet is cut to an initial shape and formed and/or sealed into the defined shapes and structures set forth below. It should be appreciated that the single sheet of stock material is intended to be made primarily of one of the foregoing materials, but can include other trace materials, e.g., additives such as antioxidants, color pigment, slip agents, etc. Furthermore, it should be appreciated that the wall 100 can also contain an oxygen barrier layer comprising Ethylene-Vinyl-Alcohol or Poly-vinyl-Alcohol or a barrier coating such as metals, metal oxides or polymeric cellulose nano crystals. In some examples, the wall 100 is made of renewable resources such as: paper and other cellulose-based materials; Polylactic acid; Polybutylene succinate; Thermoplastic Starch; Polyhydroxalkanoate; Polyhydroxybutyrate; and combinations thereof.

Generally, it should be appreciated that the thickness of the wall stock material is less than or equal to the thickness of the rigid base stock material. In some examples, the thickness of the wall stock material is selected from the range of 10-1500 microns. In some examples, the thickness of the wall stock material is less than 1500 microns, or is selected from the range of 50-500 microns, from the range of 100-250 microns, or is less than 250 microns. Preferably, the wall stock material is thin enough to be flexible such that a user may squeeze the pouch 10 to partially dispense the stored product while being thick enough to stand upright on the base 200 and support the closure system 300. In these examples, the thickness of the wall 100 may be between 150 and 250 microns. The semirigid wall stock material enables the wall 100 (and therefore the pouch 10 as a whole) to maintain a consistent, three-dimensional shape during and following product dispensing.

As shown in FIGS. 4 and 6, wall 100 includes an upper edge 102, a lower edge 104, outer surface 132, an inner surface 134, a first vertical end 114, and a second vertical end 116. Inner surface 134 of the wall 100 is the surface configured to face inward, and substantially form the external barrier that defines internal space S, e.g., where inner surface 134 is configured to contact the stored foodstuffs within space S. The outer surface 132 is the surface diametrically opposed to inner surface 134, such that, when assembled and sealed (discussed below), the outer surface 132 faces the user or other outside elements external to the pouch 10. In some examples, the outer surface 132 is configured to contact the inside of a user's hand when squeezing or dispensing foodstuffs from pouch 10. It should be appreciated that the wall 100 can take the shape of a substantially rectangular piece of material or may be formed with angular deviations from a rectangle.

The upper edge 102 is conceptually divided into two primary portions, i.e., a first upper edge seal portion 106 and a second upper edge seal portion 108. After the wall 100 is cut from a single sheet of stock material, the upper edge 102 is folded together such that the first upper edge portion 106 and the second upper edge portion 108 are sealed together along the surface area shown above the horizontal dashed lines proximate to upper edge 102 in FIG. 6, forming the upper seal 130 (which substantially acts as the top of pouch 10 and the upper boundary for internal space S). The gaps in the horizontal dash lines represent the placement of the spout 304 of the closure assembly 300, which will be discussed in greater detail below. These two upper edge seal portions 106, 108 can be sealed together using one or more sealing techniques, e.g., heat sealing, conduction sealing, induction sealing, adhesive sealing, ultrasonic bonding, welding, laser sealing or any combination thereof.

As alluded to above, the upper edge 102 further includes a first upper edge spout portion 110 and a second upper edge spout portion 112. More specifically, the first upper edge spout portion 110 is arranged within the first upper edge seal portion 106, while the second upper edge spout portion 112 is arranged within the second upper edge seal portion 108. The upper edge spout portions 110, 112 are configured to seal to the spout 304 of the closure assembly 300 when the upper edge 102 of the wall 100 is folded together to form the upper seal 130. In the example of FIG. 6, the upper edge spout portions 110, 112 are positioned such that the spout 304 will be horizontally centered in the pouch 10 when the upper seal 130 is formed, such as in the example of FIG. 2. However, the spout 304 may be arranged in any practical position about the upper seal 130.

Lower edge 104 is configured to be one continuous edge arranged to wrap around the entire perimeter surface 204 of the base 200 and seal to the perimeter surface 204, substantially forming the lower seal 132 along the surface area below the horizontal dashed line proximate to lower edge 104 in FIG. 6. Lower seal 134 is established between this surface area and perimeter surface 204 of base 200 via one or more sealing techniques, e.g., heat sealing, conduction sealing, induction sealing, adhesive sealing, ultrasonic bonding, welding, laser sealing or any combination thereof. The lower edge 104 is intended to cover the entire width and length of each side face of the perimeter surface 204 such that, when sealed to the base 200, the lower edge 104 is substantially coincident with the lowest edge of the base perimeter 202, i.e., the lower edge 104 and the outer surface 206 of the base 200 simultaneously contact the planar surface on which pouch 10 is standing on. It should be appreciated that additional layers of material can be provided along upper edge 102 and/or along lower edge 104 to add additional stiffness as necessary.

Further, in some examples, a third seal 136 is formed by sealing the first end 114 to the second end 116 of the wall 100 as a butt joint 118 (as shown in FIG. 2). These ends 114, 116 are "vertical" in that they are substantially orthogonal to the upper edge 102 and the lower edge 104 such that, when the pouch 10 is free-standing on the outer base surface 206, these portions will be disposed substantially vertically. Although not illustrated, it should be appreciated that these vertical sections do not need to be substantially orthogonal to the upper edge 102 and the lower edge 104, and can be disposed at other angles deviated from orthogonal, e.g., 5 degrees, 10 degrees, 15 degrees, etc. The butt joint 118 is formed by placing the first and second ends 114, 116 in contact with each other, i.e., abutting each other, and affixing, securing, or sealing one or more pieces of additional material over the ends 114, 116, sealing them together. By having at least one piece of additional material sealed over the two vertical ends of the wall 100, the space S can be completely sealed off. In some examples, two pieces of additional material can be used to seal the butt-joint 118, e.g., one piece on the inner surface 134 of ends 114, 116 and the other piece on the outer surface 132 of the ends 114, 116. In some examples, the additional piece or additional pieces of material described herein can be a translucent, transparent, or opaque material, e.g., plastic, paper, or any of the other material types used to form the wall 100. In a preferred example, seal tape 120 is applied longitudinally along the butt joint 118 between the upper seal 130 and the lower seal 132. Use of the seal tape 120 may be particularly important when the wall 100 is a paper-based material, such as plastic-coated paper. The cross-sectional edge of the coated paper may be uncoated, thereby exposing the paper to the contents of the pouch 10 potentially leading to wall 100 being damaged. Using seal tape 120 on the inner surface 134 of the wall 100 will protect the uncoated cross-sectional edges of the wall 100 from the contents of the container 10.

Figure 7:
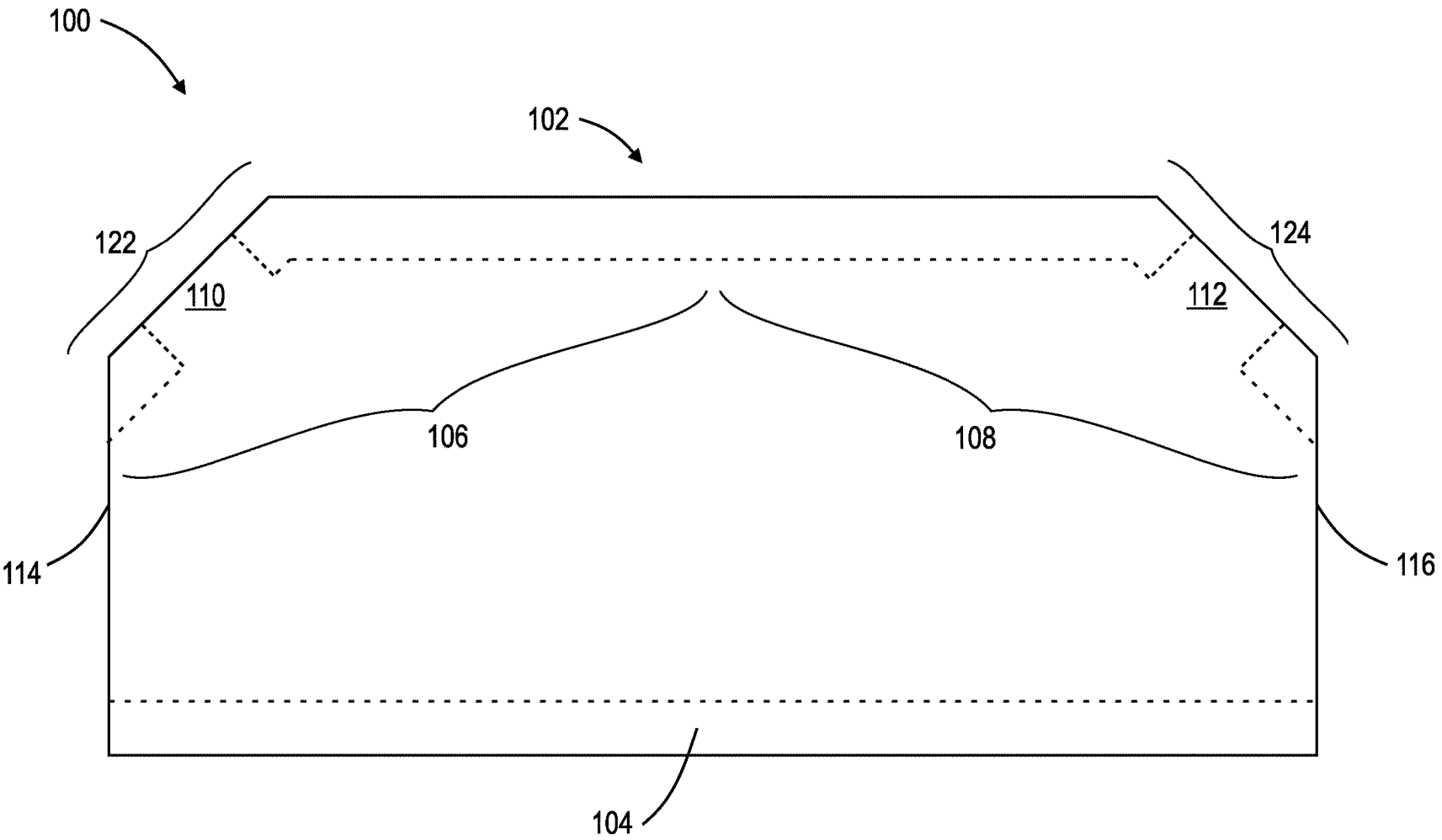
FIG. 7 is a side elevational view of a second example of an unassembled wall, according to the present disclosure.

FIG. 7 illustrates a variation of the unassembled wall 100 of FIG. 6, and more specifically, a variation of the upper edge 102 forming the upper seal 130. Like the example of FIG. 6, the upper edge 102 of FIG. 7 includes a first upper edge seal portion 106 and a second upper edge seal portion 108 configured to form the upper seal 130 when the upper edge 102 is folded over onto itself. Further, the first upper edge seal portion 106 includes the first upper edge spout portion 110, and the second upper edge seal portion 108 includes the second upper edge spout portion 112. However, as illustrated in FIG. 7, the upper edge 102 further includes a first chamfer portion 122 and a second chamfer portion 124, such that the first chamfer portion 122 is arranged within the first upper edge seal portion 106, and the second chamfer portion 124 is arranged within the second upper edge seal portion 108. The chamfer portions 122, 124 correspond to chamfer cuts out of the corners of the wall 100. Further, the first upper edge spout portion 110 is arranged within the first chamfer portion 122, and the second upper edge spout portion 112 is arranged within the second chamfer portion 124. Thus, by arranging the spout 104 within the chamfer portions 122, 124 and folding over the upper edge 102 onto itself to form the upper seal 130, the pouch 10 of FIG. 3 may be assembled.

Figure 8:
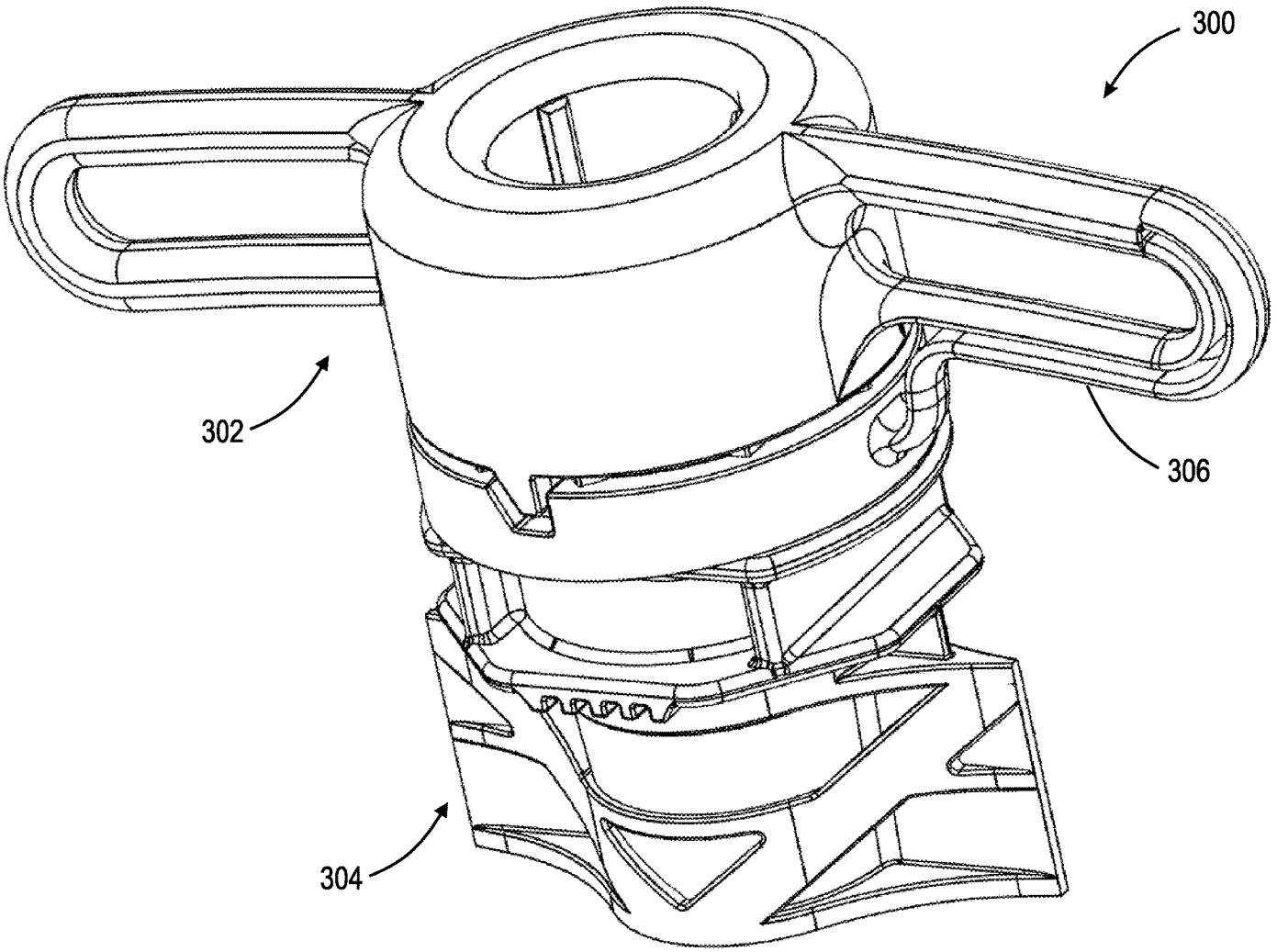
FIG. 8 is a top isometric view of a closure assembly, according to the present disclosure.
Figure 9:
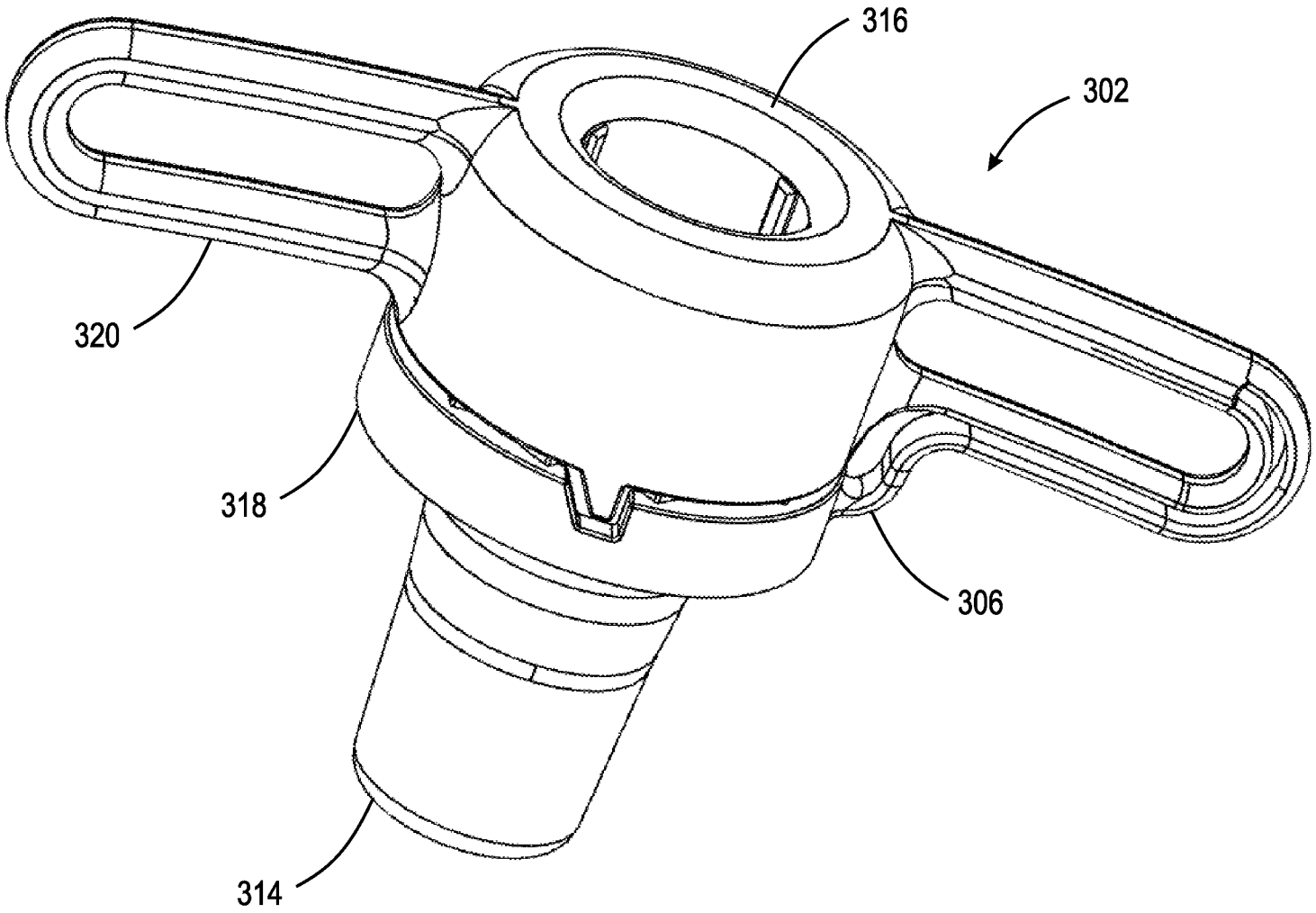
FIG. 9 is a top isometric view of a cap of a closure assembly, according to the present disclosure.
Figure 10:
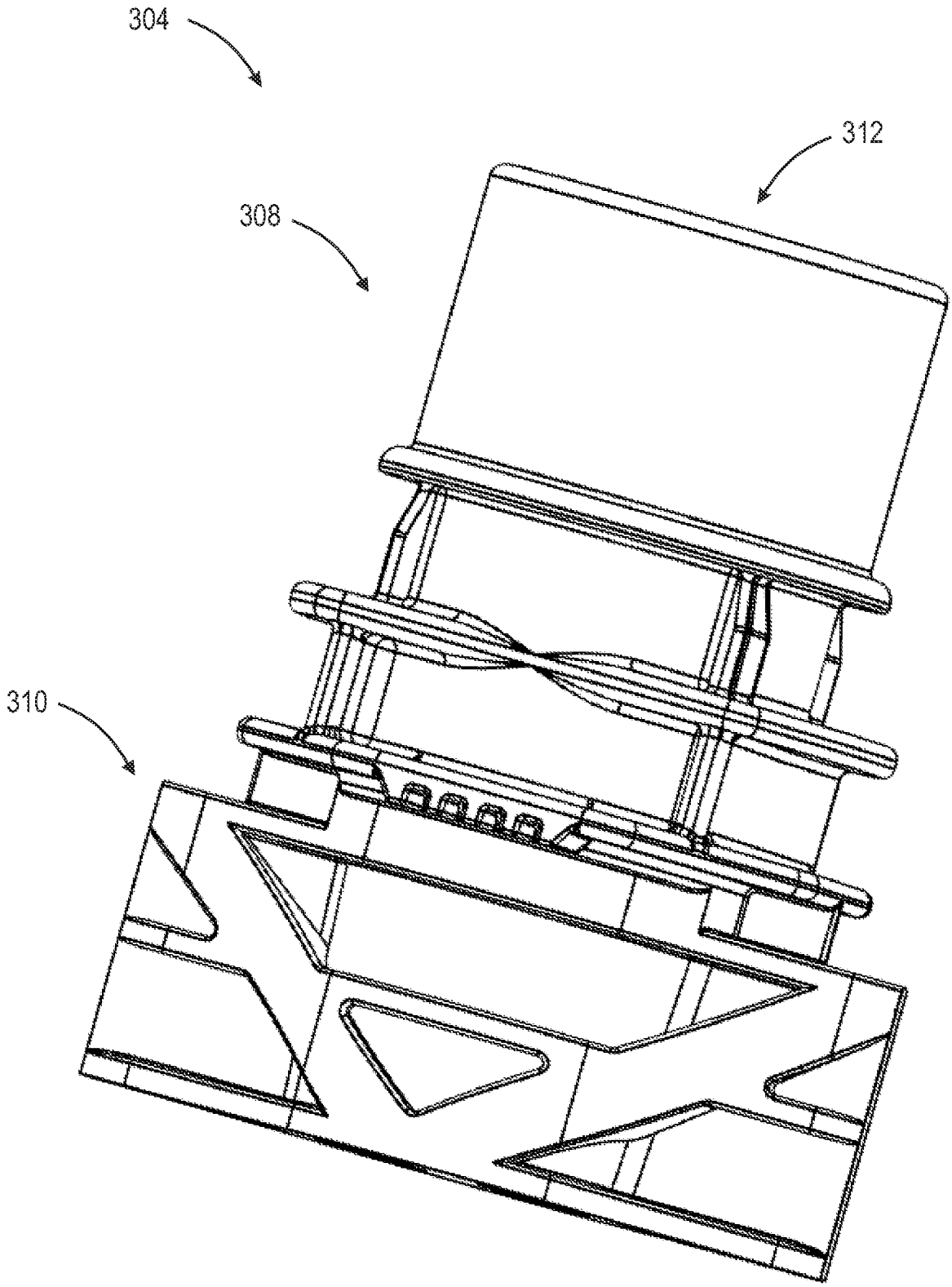
FIG. 10 is a bottom isometric view of a spout of a closure assembly, according to the present disclosure.

FIGS. 8-10 illustrate various aspects of the closure system 300. As illustrated in FIGS. 8-10, closure system 300 includes a cap 302 and a spout 304. FIG. 8 illustrates an isometric elevational view of closure system 300 in an assembled state. FIG. 9 is an isometric view of the cap 302, while FIG. 10 is an isometric view of the spout 304. As illustrated, spout 304 includes a conduit 308 and a seal member 310. Conduit 308 is intended to be a tube, straw, or other longitudinal body with an inner volume configured to provide fluid communication of foodstuffs between pouch 10 and, for example, a user's mouth when engaged with conduit 308. As used herein, and in addition to its ordinary meaning with the art, the term "fluid communication" is intended to mean the flow, movement, or transfer of a material from a first location to a second location different than the first, and can refer to the movement of solids, liquids, semi-solids, or liquids with solid parts from the first location to the second location. Although illustrated as a substantially tubular member, it should be appreciated that the conduit 308 can take any substantially longitudinal shape, e.g., any shape having a first end, a second end, and a through-bore arranged between the first and second ends to provide fluid communication of foodstuffs. At each end of the conduit 308, conduit 308 includes an aperture. As illustrated, conduit 308 includes a first aperture 312 arranged proximate to a first end of conduit 308, where the first end of conduit 308 and thus first aperture 312 will be positioned within the user's mouth while the user is engaged with spout 308 and/or pouch 10. The conduit 308 also includes a second aperture (not shown) arranged proximate to a second end of conduit 308, where the second end of the conduit 308 is disposed within or secured to seal member 310 and located within pouch 10 when sealed.

The seal member 310 is intended to be a substantially lateral member that is configured to receive and seal or otherwise permanently engage with the interior of pouch 10. In particular, the seal member 310 is intended to be affixed to the upper edge 102 of the unitary wall 100 within the first and second upper edge spout portions 110, 112 as shown, for example, in FIGS. 6 and 7. In some examples, seal member 310 includes one or more surfaces configured to be fixedly secured to the upper edge 102 of the wall 100 via heat sealing, conduction sealing, induction sealing, adhesive sealing, ultrasonic bonding, welding, laser sealing, or any combination thereof.

In some examples, spout 304, i.e., both conduit 308 and seal member 310, is/are made from a thermoplastic resin material selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide or any combination thereof. The seal member 310 may include one or more discrete layers of thermoplastic resin material and/or one or more layers of barrier material. Additionally, the conduit 308 can also include one or more discrete layers of thermoplastic resin material and/or one or more layers of barrier material.

The cap 302 is intended to rotatingly engage and disengage from spout 304, e.g., from conduit 308, and is arranged to cover, encompass, and seal at least the first aperture 312 of the conduit 308 such that foodstuffs stored within pouch 10 are prevented from exiting the aperture 312 when the cap 302 is engaged with the spout 304. The cap 302 includes a body portion 316, a lower ring 318, and at least one tether 306 coupling the body portion 316 to the lower ring 316. The body portion 316 is a substantially cylindrical body configured to encompass, cover, close, and seal the first aperture 112 of the conduit 106 when the cap 104 is engaged with the spout 304. The body portion 316 also includes a protrusion 314 configured to fill an inner volume of the conduit 308 to provide additional leakage protection when the cap 302 is engaged with the spout 304. The body portion 316 further includes one or more tabs 320 configured to engage with a user such that the user can easily rotatingly disengage and/or re-engage the cap 104 from spout 102.

The lower ring 318 is intended to be a ring-shaped annulus and is arranged to completely radially encompass at least a portion of the vertical height of spout 304. For example, the lower ring 318 is intended to completely surround or encompass at least a portion of the conduit 308 and is arranged concentrically about the conduit 308. In some examples, the lower ring 318 is configured to surround and rotatingly engage with a portion of conduit 308 such that the lower ring 318 stays rotatingly engaged with conduit 308 at all times after assembly.

Further, at least one tether 306 is configured to flexibly connect the body portion 316 and the lower ring 318 of the cap 302 such that, in the event a user removes or disengages the body portion 316 from the spout 308, for example, when attempting to remove and ingest stored foodstuffs from within pouch 10, the body portion 316 is no longer preventing or sealing the first aperture 112 of conduit but is still flexibly connected to the conduit 308 via the at least one tether 306 and the lower ring 318. Tethering the body portion 316 of the cap 302 to the conduit 308 of the spout 304 (and therefore to the rest of the pouch 10) allows for compliance with recycling stream standards prohibiting separable materials in an attempt to ensure the entire pouch 10 (including all aspects of the wall 100, the base 200, and the closure system 300) is recycled. It should be appreciated that the at least one tether 306 can be made of the same materials as the body portion 316 and/or the lower ring 318 and that the body portion 316, the lower ring 318, and/or the tether 306 can be molded or otherwise formed in a single operation or as a single unitary part.

Figure 11:
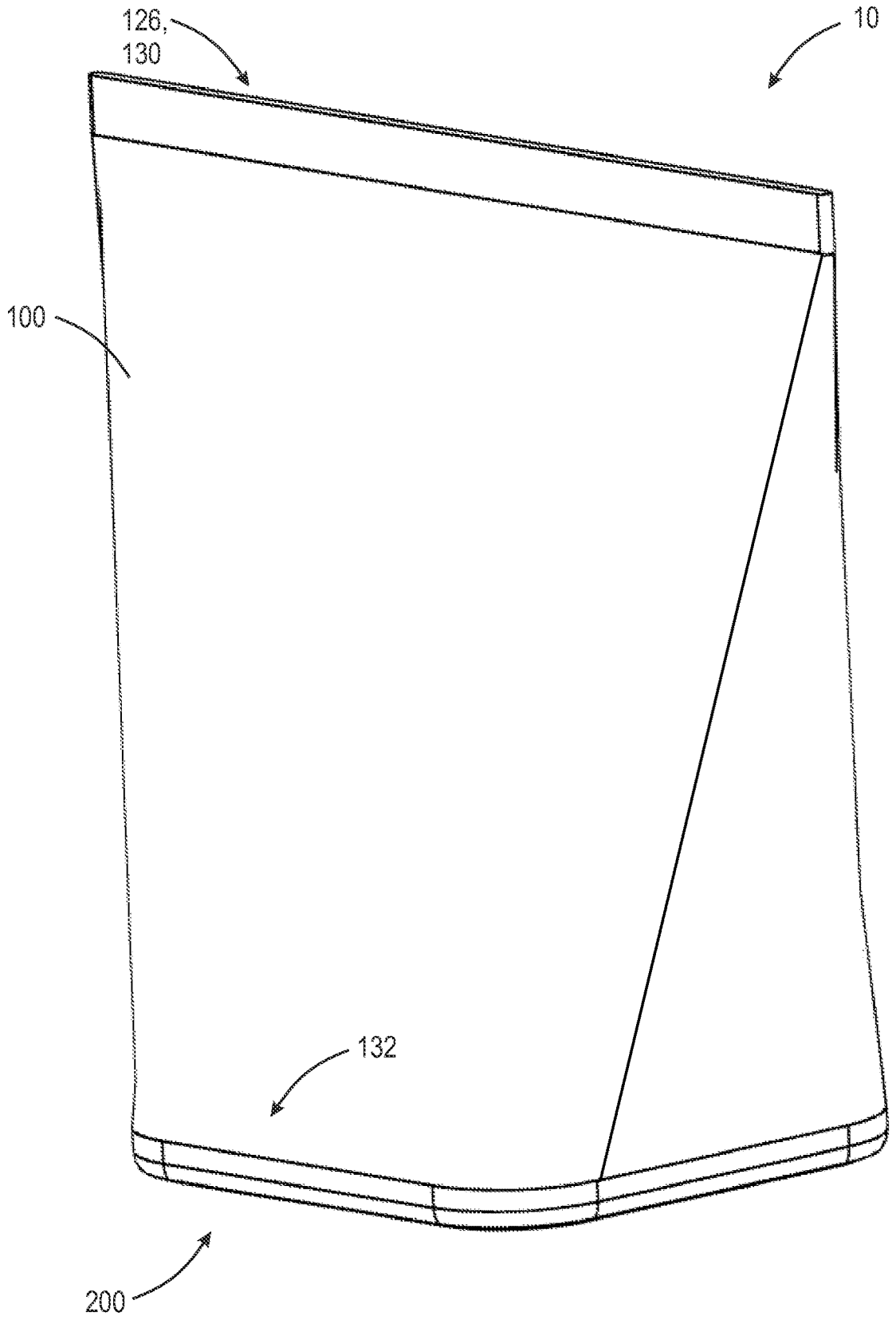
FIG. 11 is a top isometric view of a further example of a pouch, according to the present disclosure.
Figure 12:
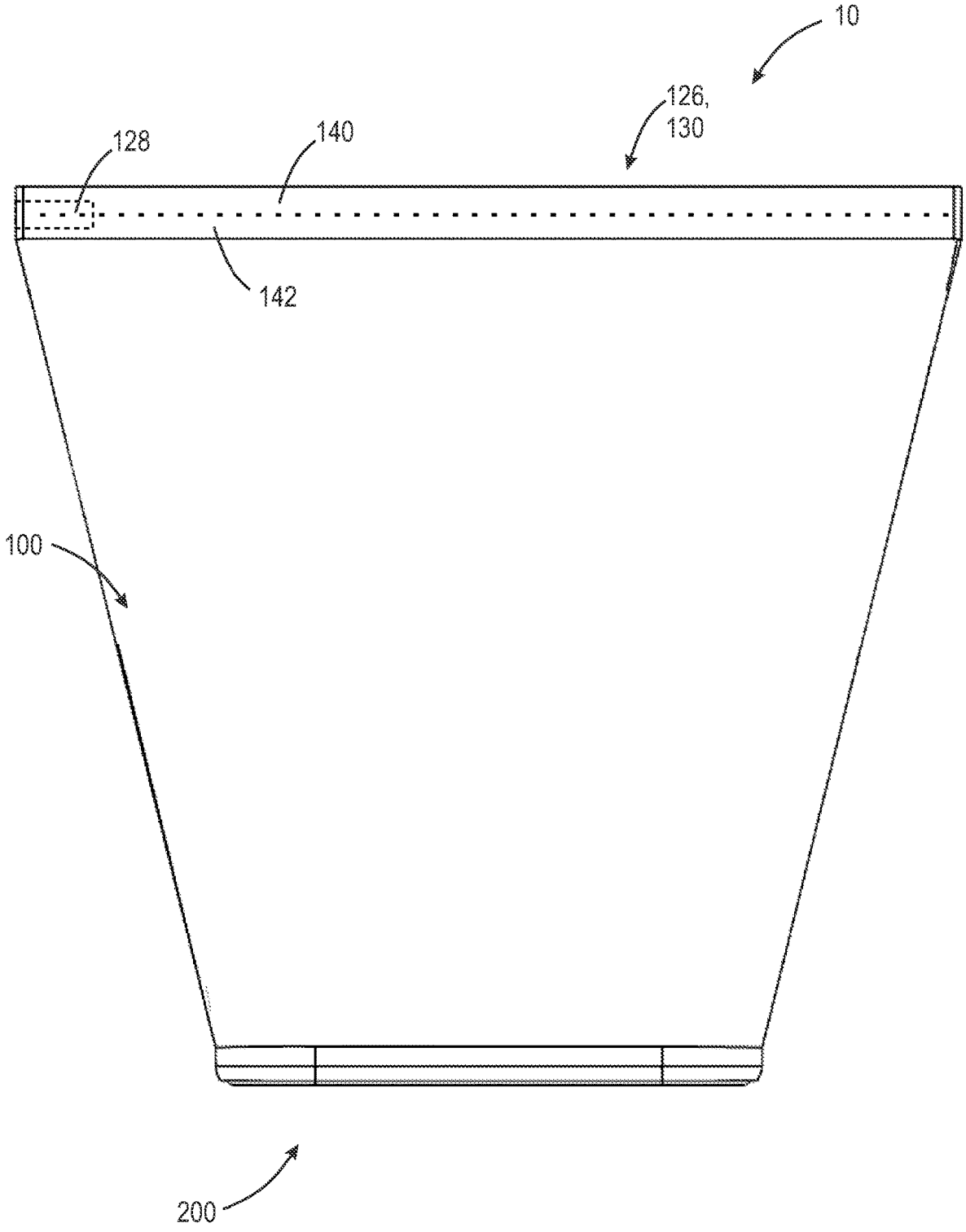
FIG. 12 is a front view of the further example of a pouch of FIG. 11, according to the present disclosure.

FIGS. 11 and 12 illustrate a variation of the pouch 10 shown in FIG. 2, more specifically, a pouch 10 configured with an upper seal 130 (rather than a closure system 300) in the form of a tear open seal 126 to enable a user to access the contents of the pouch 10. FIG. 11 illustrates a top isometric view of the pouch 10 having the tear away seal 126, while FIG. 12 illustrates a front view of the same pouch 10. Conceptually, the tear open seal 126 shown in FIGS. 11 and 12 replaces the upper seal 130 shown in FIG. 2. When the tear open seal 126 is broken, the semirigid wall 100 may flex to create an opening along the upper edge 102 to enable a user to access the contents within the pouch 10.

Generally, the pouch 10 of FIGS. 11 and 12 includes at least two seals; a lower seal 132 affixing the lower edge 104 of the wall 100 to the base 200, and the tear open seal 126 affixing the first upper edge seal portion 106 of the wall 100 to the second upper edge seal portion 108. In some examples, the pouch 10 further includes a third seal 136 joining together two vertical ends 114, 116 of the unitary wall 100. The third seal 136 may be formed as a butt joint 118 overlayed with seal tape 120 on the inner surface 132 and/or the outer surface 134 of the wall 100.

The tear open seal 126 is configured as an opening mechanism for the user to easily break the seal 126 to access the contents of the pouch 10. In some examples, the tear open aspect of the seal 126 is manufactured by laser scoring a seal formed between two upper edge seal portions 106, 108 of the wall 100. In further examples, a tear notch or tear tape may be incorporated in the tear open seal 126 to break the seal 126.

FIG. 12 illustrates an example of a tear open seal 126. The tear open seal 126 includes an upper tear portion 140 configured to be at least partially separated from the rest of the wall 100 when the seal 126 is broken. The tear open seal 126 also include a lower tear potion 142 configured to remain integrated with the wall when the seal 126 is broken. The tear open seal 126 further includes seal tape 128. The seal tape 128 may cover the outer surface of the tear away seal 126, or the seal tape 128 may be integrated within the tear away seal 126. In either configuration, the seal tape 128 prevents the upper tear portion 140 from completely separating from the lower tear portion 142. Like the tethering feature of the closure assembly 300, preventing the upper tear portion 140 from completely separating from the rest of the pouch 10 allows for compliance with recycling stream standards prohibiting separable materials in an attempt to ensure the entire pouch 10 is recycled. In some examples, the tear open seal 126 may include resealable features, such as a zipper.

Figure 13:
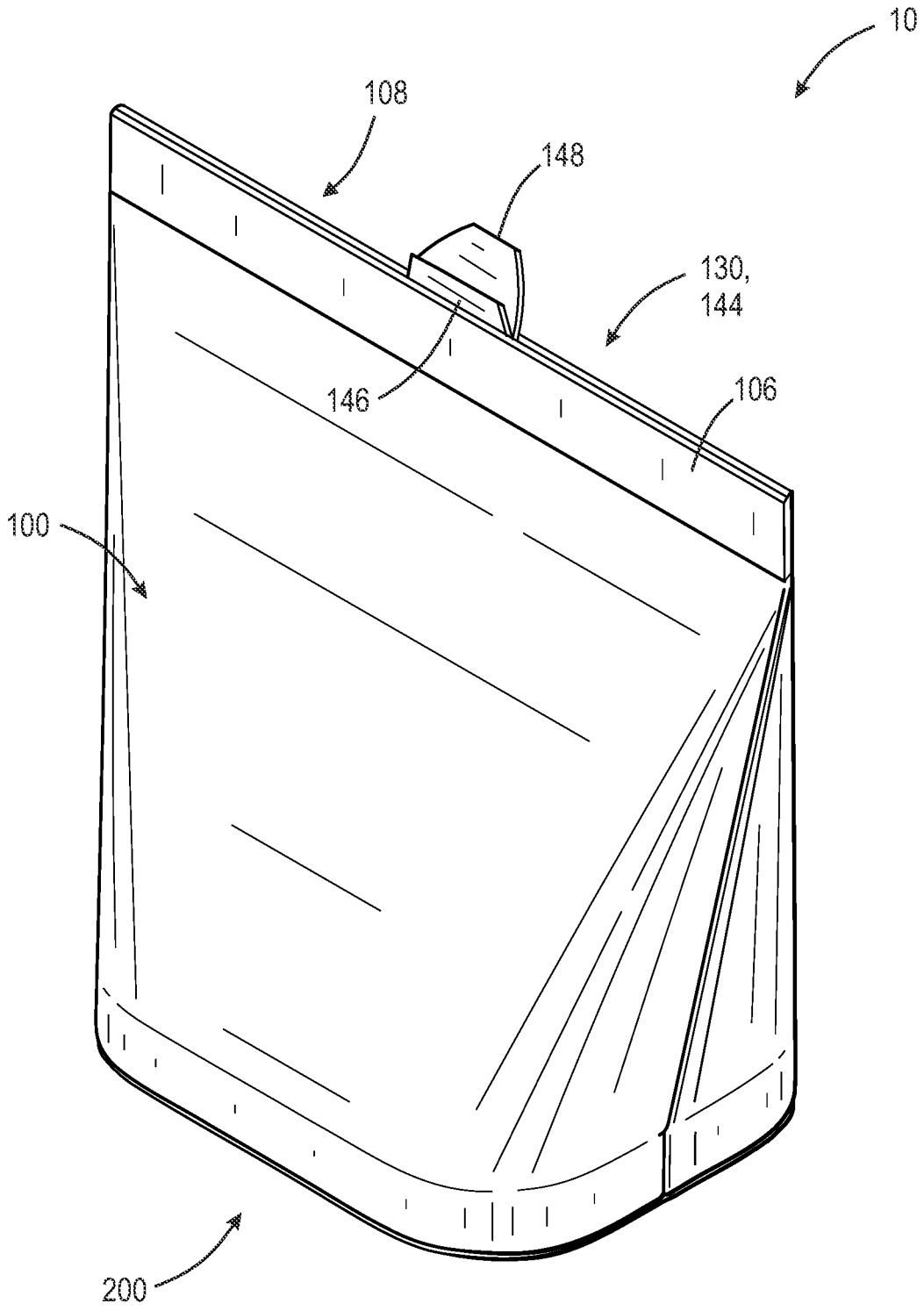
FIG. 13 is a top isometric view of a further example of a pouch, according to the present disclosure.

FIG. 13 illustrates a further variation of the pouch 10. In this example, the upper seal 130 is embodied as a peelable seal 144, rather than the tear open seal 126 shown in FIGS. 11 and 12. In this example, the first and second upper edge seal portions 106, 108 of the wall 100 are sealed together using a resin or other adhesive material. A first tab 146 is affixed to the first upper edge seal portion 106 of the wall 100, while a second tab 148 is affixed to the second upper edge seal portion 108 of the wall 100. Thus, a user may easily peel open the peelable seal 144 by pulling the first tab 146 and the second tab 148 away from each other to separate the first and second upper edge seal portions 106, 108. While example tabs 146, 148 are illustrated in FIG. 13, the tabs 146, 148 may be any size or shape required to facilitate the separation of the first and second upper edge seal portions 106, 108. The force required to peel apart the first and second upper edge seal portions 106, 108 may be configured according to the properties of the resin or other adhesive material. In some examples, the resin or other adhesive material may be coextruded with the wall 100 during manufacturing. It should be understood that unlike the tear open seal 126 of FIGS. 11 and 12, the peelable seal 144 does not require scoring, thereby simplifying the manufacturing process.

Figure 14:
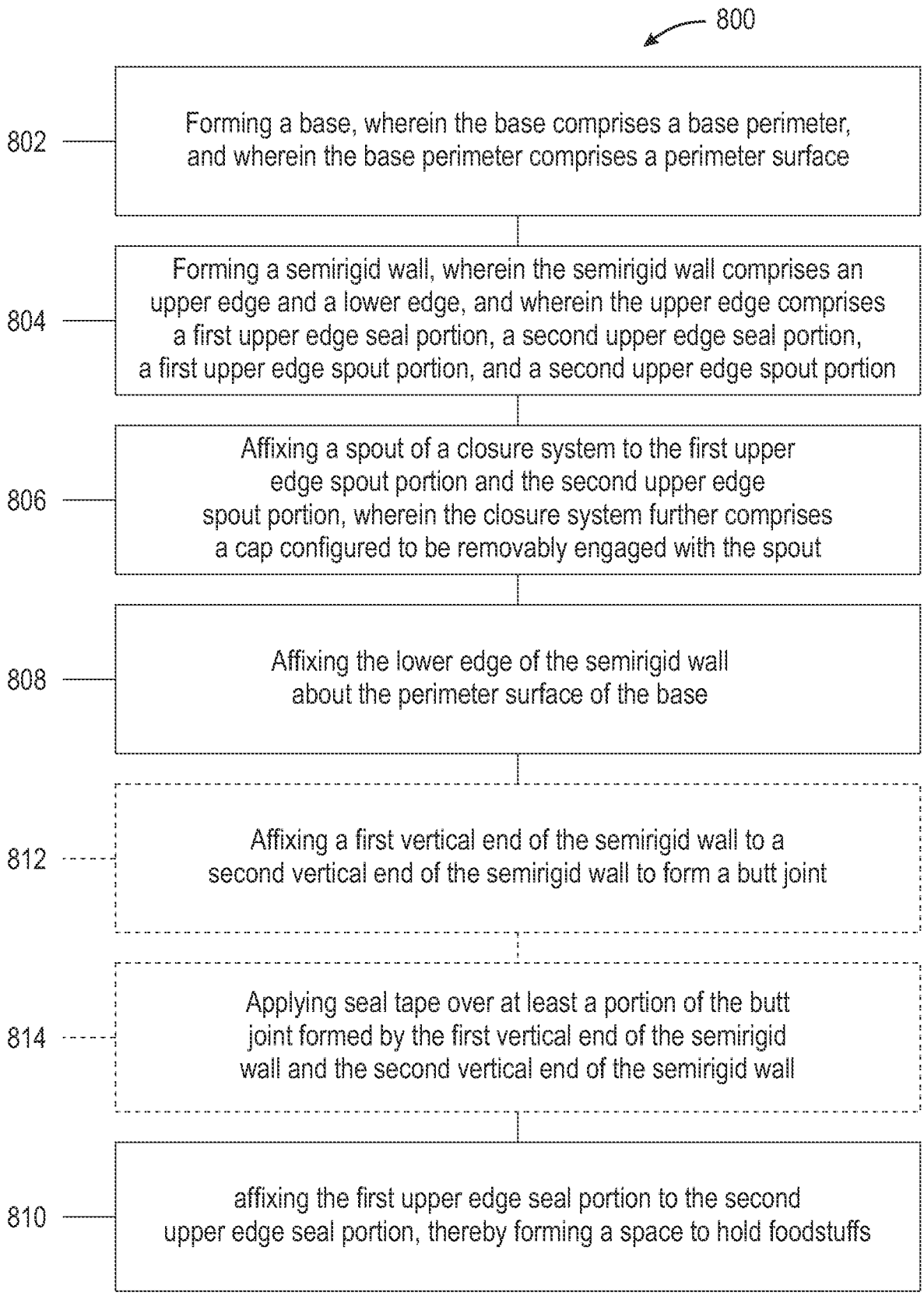
FIG. 14 illustrates a flow chart of the steps of a method according to the present disclosure.

FIG. 14 illustrates a flow chart of the steps of a method 800 for manufacturing the pouch 10 as shown, for example, in FIGS. 1 and 2. The method 800 includes, in step 802, forming a base 200. The base 200 includes a base perimeter 202. The base perimeter 202 includes a perimeter surface 204.

The method 800 further includes, in step 804, forming a semirigid wall 100. The semirigid wall 100 includes an upper edge 102 and a lower edge 104. The upper edge 102 includes a first upper edge seal portion 106, a second upper edge seal portion 108, a first upper edge spout portion 110, and a second upper edge spout portion 112.

The method 800 further includes, in step 806, affixing a spout 304 of a closure system 300 to the first upper edge spout portion 110 and the second upper edge spout portion 112. The closure system 300 further includes a cap 302 configured to be removably engaged with the spout 304.

The method 800 further includes, in step 808, affixing the lower edge 104 of the semirigid wall 100 about the perimeter surface of the base.

The method 800 further includes, in step 810, affixing the first upper edge seal portion 106 to the second upper edge seal portion 108, thereby forming a space S to hold foodstuffs.

According to an example, the method 800 may further include, in optional step 812, affixing a first vertical end 114 of the semirigid wall 100 to a second vertical end 116 of the semirigid wall 100 to form a butt joint 118. The method 800 may further include, in optional step 814, applying seal tape 120 over at least a portion of the butt joint 118 formed by the first vertical end 114 of the semirigid wall 100 and the second vertical end 116 of the semirigid wall 100.

Figure 15:
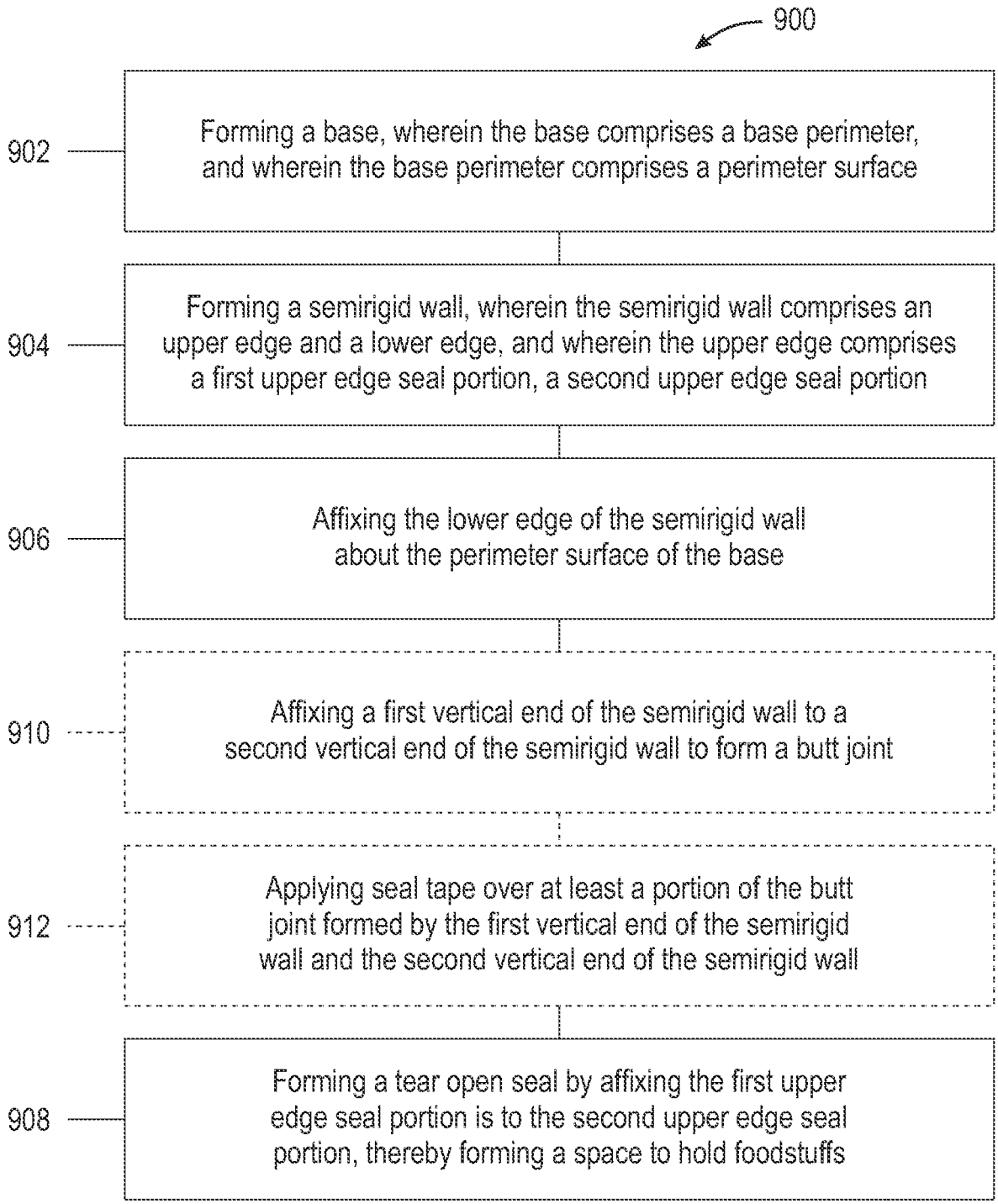
FIG. 15 illustrates a flow chart of the steps of a method according to the present disclosure.

FIG. 15 illustrates a flow chart of the steps of a method 900 for manufacturing the pouch 10 as shown, for example, FIGS. 11 and 12. The method 900 includes, in step 902, forming a base 200. The base 200 includes a base perimeter 202. The base perimeter 202 includes a perimeter surface 204.

The method 900 may further include, in step 904, forming a semirigid wall 100. The semirigid wall 100 includes an upper edge 102 and a lower edge 104. The upper edge 102 includes a first upper edge seal portion 106 and a second upper edge seal portion 108.

The method 900 may further include, in step 906, affixing the lower edge 104 of the semirigid wall 100 about the perimeter surface of the base 200.

The method 900 may further include, in step 908, forming a tear open seal 126 by affixing the first upper edge seal portion 106 to the second upper edge seal portion 108, thereby forming a space S to hold foodstuffs.

According to an example, the method 900 may further include, in optional step 910, affixing a first vertical end 114 of the semirigid wall 100 to a second vertical end 116 of the semirigid wall 100 to form a butt joint 118. Further to this example, the method 900 may further include, in optional step 912, applying seal tape 128 over at least a portion of the butt joint 118 formed by the first vertical end 114 of the semirigid wall 100 and the second vertical end 116 of the semirigid wall 100.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A semirigid pouch for storing and dispensing foodstuffs, comprising:

a base comprising a base perimeter and an inner surface, wherein the base perimeter comprises a perimeter surface;

a semirigid wall formed from a single sheet of stock material and comprising an upper edge and a lower edge, wherein the upper edge comprises a first upper edge seal portion and a second upper edge seal portion, and wherein the lower edge of the semirigid wall is affixed about the perimeter surface of the base such that the semirigid wall encompasses the inner surface of the base when the semirigid pouch is formed; and an upper seal formed by affixing the first upper edge seal portion to the second upper edge seal portion, thereby forming a space to hold the foodstuffs, wherein the upper seal is configured to be opened to access the space to hold the foodstuffs;

wherein the semirigid pouch is configured to maintain a consistent three-dimensional shape during and following dispensing of the foodstuffs.

2. The semirigid pouch of claim 1, wherein the upper seal is a tear open seal.

3. The semirigid pouch of claim 2, wherein upon at least partially breaking the tear open seal, the first upper edge seal portion at least partially separates from the second upper edge seal portion.

4. The semirigid pouch of claim 2, wherein seal tape is applied to the tear open seal to prevent an upper tear portion of the tear open seal from completely detaching from a lower tear portion of the tear open seal.

5. The semirigid pouch of claim 1, wherein the semirigid wall further comprises a first vertical end and a second vertical end, and wherein the first vertical end is affixed to the second vertical end to form a butt joint, and wherein seal tape is applied over at least a portion of the butt joint formed by the first vertical end and the second vertical end.

6. The semirigid pouch of claim 1, wherein the base is semirigid and/or transparent.

7. The semirigid pouch of claim 1, wherein the upper seal is a peelable seal.

8. A method for manufacturing a semirigid pouch for storing and dispensing foodstuffs, wherein the semirigid pouch is configured to maintain a consistent three-dimensional shape during and following dispensing of the foodstuffs, the method comprising:

forming a base, wherein the base comprises a base perimeter and an inner surface, and wherein the base perimeter comprises a perimeter surface;

forming a semirigid wall from a single sheet of stock material, wherein the semirigid wall comprises an upper edge and a lower edge, and wherein the upper edge comprises a first upper edge seal portion and a second upper edge seal portion;

affixing the lower edge of the semirigid wall about the perimeter surface of the base such that the semirigid wall encompasses the inner surface of the base when the semirigid pouch is formed; and forming an upper seal by affixing the first upper edge seal portion to the second upper edge seal portion, thereby forming a space to hold the foodstuffs, wherein the upper seal is configured to be opened to access the space to hold the foodstuffs.

9. The method of claim 8, further comprising affixing a first vertical end of the semirigid wall to a second vertical end of the semirigid wall to form a butt joint.

10. The method of claim 9, further comprising applying seal tape over at least a portion of the butt joint formed by the first vertical end of the semirigid wall and the second vertical end of the semirigid wall.

* * * * *